US005364748A

United States Patent [19]

Yoneyama

[11] Patent Number: 5,364,748

[45] Date of Patent: Nov. 15, 1994

[54] SILVER HALIDE COLOR PHOTOGRAPHIC LIGHT-SENSITIVE MATERIAL

[75] Inventor: Hiroyuki Yoneyama, Minami Ashigara, Japan

[73] Assignee: Fuji Photo Film Co., Ltd., Kanagawa, Japan

[21] Appl. No.: 87,330

[22] Filed: Jul. 8, 1993

[30] Foreign Application Priority Data

Jul. 9, 1992 [JP] Japan ..... 4-221889

[51] Int. Cl.[5] ..... G03C 1/46

[52] U.S. Cl. ..... 430/505; 430/503; 430/558; 430/553; 430/507; 430/523; 430/950; 430/538

[58] Field of Search ..... 430/503, 505, 558, 553, 430/507, 523, 950, 538

[56] References Cited

U.S. PATENT DOCUMENTS

| | | | |
|---|---|---|---|
| 5,151,345 | 9/1992 | Hasebe | 430/523 |
| 5,215,871 | 6/1993 | Sato et al. | 430/558 |
| 5,234,804 | 8/1993 | Sato et al. | 430/538 |
| 5,256,526 | 10/1993 | Suzuki et al. | 430/558 |
| 5,262,290 | 11/1993 | Nakatsugawa et al. | 430/538 |

*Primary Examiner*—Thomas R. Neville
*Attorney, Agent, or Firm*—Sughrue, Mion, Zinn, Macpeak & Seas

[57] ABSTRACT

There is disclosed a silver halide color photo-graphic light-sensitive material capable of providing a dye image having excellent color reproducibility, sharpness and image fastness. The light-sensitive material comprises a support having provided thereon a photographic constituent layer comprising a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and non-light-sensitive hydrophilic colloid layers. The above silver halide emulsion layer containing the cyan dye-forming coupler contains at least one cyan dye-forming couplers represented by the following Formula (Ia), and wherein at least one of the non-light-sensitive hydrophilic colloid layers is provided between the support and the silver halide emulsion layer closest to the support and contains a white pigment in a filling rate of 20 weight % or more:

Formula (Ia)

wherein Za represents —NH— or —CH($R_3$)—, and Zb and Zc each represents —C($R_4$)= or —N=; $R_1$, $R_2$ and $R_3$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$ groups are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine with a polymer higher than a dimer and a high molecular chain to form a homopolymer or a copolymer.

18 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, specifically to a silver halide color photographic light-sensitive material capable of providing a dye image having excellent color reproducibility, sharpness and image fastness.

BACKGROUND OF THE INVENTION

Although there have been improvements on the quality in the color images obtained with silver halide color photographic light-sensitive materials, there is a need for further improvement. The quality of the color image is determined by various performance characteristics such as gradation reproduction, color reproduction, graininess, and sharpness. Among them, color reproduction and sharpness are the important factors that exert an influence upon the visual sharpness of an image. Additionally, there is a need to improve expression at details and the above factors themselves. Further, with color print materials, it is desired from the viewpoint of the recording medium part thereof that it is kept unchanged without deterioration even after storing at various conditions over a long period of time.

In order to improve color reproduction, improvements have been attempted in the spectral absorption characteristics of the yellow, magenta and cyan dyes each formed from a coupler by coupling with the oxidation-product of a developing agent. The cyan couplers mentioned below have been investigated for the purpose of improving the spectral absorption characteristics of the cyan dye. That is, there have been investigated the diphenylimidazole series couplers described in JP-A-2-33144 (the term "JP-A" as used herein means an unexamined Japanese patent application), the 3-hydroxypyridine series couplers described in European Patent EP 0,333,185, the cyclic active methylene series cyan couplers described in JP-A-64-32260, the pyrrolopyrazole type cyan couplers described in European Patent EP 0,456,226, the pyrroloimidazole type cyan couplers described in European Patent EP 0,488,909, and the pyrroloazole type cyan couplers described in European Patents EP 0,488,248 and EP 0,491,197.

Meanwhile, several attempts have been made in order to improve image sharpness. In order to obtain an image having a high sharpness, a measure must be taken so that light of an exposure is not spread over a wide range on the print face to generate fading. There are known as the method for the prevention of this spreading, a method in which a water soluble dye is used in order to prevent irradiation generated on an emulsion layer provided on a support, a method in which a coloring layer (AH) is provided in order to prevent halation, and a method in which the reflection rate is raised in the vicinity of the surface on a reflection type support in order to prevent a blur in the support.

Of these methods, there is described a method for preventing a blur in JP-A-3-156439, a method in which a white pigment is incorporated into a waterproof resin layer covering a reflection type support in a proportion of 14% or more. Further, there is described in JP-A-57-64235 and JP-A-62-187846, a method in which a hydrophilic colloid layer containing a white pigment is provided between a support and a silver halide emulsion layer. However, it has been found that the application of the supports provided with these white pigments accelerates the yellowing of the background and the discoloring and fading of the cyan dye image when a color print processed and obtained is stored under the condition of high humidity.

Further, also in the methods in which a water soluble dye or AH is used, the use of a lot of dyes or an increase in the amount of coloring matter in AH in order to obtain a high sharpness, leads to the problems that a coloring agent remains without completely decoloring during processing to stain the background and that an image storing performance is deteriorated after processing.

Thus, there is no technology by which the sharpness of an image is increased and the yellowing of the background and the discoloring and fading of a dye image after a processing can be prevented. Accordingly the development of a new technology has been desired.

SUMMARY OF THE INVENTION

One object of the present invention is to provide a silver halide color photographic light-sensitive material capable of providing a dye image having excellent color reproduction, sharpness and image fastness.

The investigations intensively made by the present inventors have resulted in finding that the above and other objects can be achieved by the following silver halide color photographic light-sensitive materials:

(1) a silver halide color photographic light-sensitive material comprising a support having provided thereon a photographic constituent layer comprising a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and non-light-sensitive hydrophilic colloid layers, wherein the above silver halide emulsion layer containing the cyan dye-forming coupler contains at least one cyan dye-forming coupler represented by the following Formula (Ia) and wherein at least one of the non-light-sensitive hydrophilic colloid layers is provided between the support and the silver halide emulsion layer closest to the support and contains a white pigment at a density of 20 weight % or more:

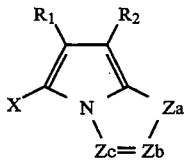

Formula (Ia)

wherein Za represents —NH— or —CH($R_3$)—, and Zb and Zc each represents —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$ groups are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine with a polymer higher than a dimer and a high molecular chain to form a homopolymer or a copolymer;

(2) a silver halide color photographic light-sensitive material comprising a reflection type support covered with a waterproof resin layer and provided on the layer a photographic constituent layer comprising a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive hydrophilic colloid layer, wherein the above silver halide emulsion layer containing the cyan dye-forming coupler contains at least one cyan dye-forming coupler represented by the following Formula (Ia) and wherein the above waterproof resin layer provided on the emulsion layer side of the support contains a white pigment at a density of 15 weight % or more:

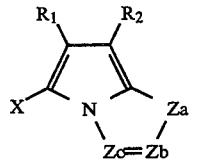

Formula (Ia)

wherein Za represents —NH— or —CH($R_3$)—, and Zb and Zc each represents —C($R_4$)= or —N=; $R_1$, $R_2$ and $R_3$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$ groups are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine with a polymer higher than a dimer and a high molecular chain to form a homopolymer or a copolymer; and (3) the silver halide color photographic light-sensitive material described in the above item (1) or (2), wherein at least one layer of the above light-sensitive emulsion layers and non-light-sensitive emulsion layer is a coloring layer capable of being decolored during a color development processing step.

It is a new finding which could not have been anticipated from the conventional technology that when a non-light-sensitive hydrophilic colloid layer containing a white pigment is provided on a support or when a white pigment is incorporated into a waterproof resin layer covering the support at a filling rate of 15 weight % or more, the provision of a coloring layer thereon allows the cyan coupler of the present invention to inhibit yellowing of the background and discoloration and fading of the dye image after processing. The non-light-sensitive hydrophilic colloid layer containing a white pigment in the density of 20 weight % or more may be substantially non-light-sensitive. The term "substantially non-light-sensitive" means "substantially not contributing to image formation."

DETAILED DESCRIPTION OF THE INVENTION

The compound of the present invention will be described below in detail.

The cyan dye-forming coupler of the present invention represented by Formula (Ia) may be represented by any Formulas (IIa) to (VIIIa):

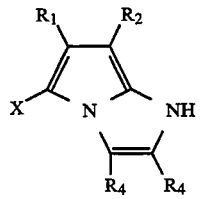

(IIa)

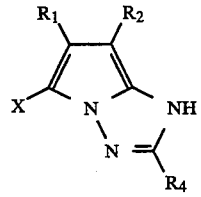

(IIIa)

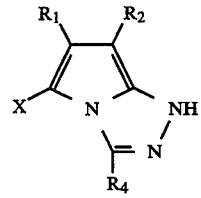

(IVa)

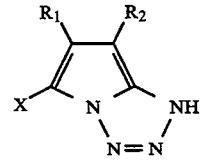

(Va)

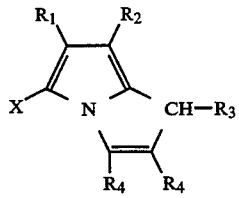

(VIa)

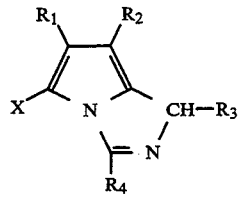

(VIIa)

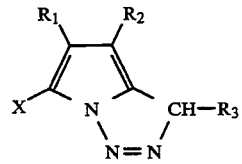

(VIIIa)

In Formulas (IIa) to (VIIIa), $R_1$, $R_2$, $R_3$, $R_4$ and X are synonymous with $R_1$, $R_2$, $R_3$, $R_4$ or X in Formula (Ia).

In the present invention, a cyan coupler represented by Formula (IIa), (IIIa) or (IVa) is preferred and the cyan coupler represented by Formula (IIIa) is particularly preferred.

In the cyan coupler of the present invention, $R_1$, $R_2$ and $R_3$ is each an electron attractive group having a Hammett's substituent constant $\sigma_p$ value of 0.20 or more, and the sum of the $\sigma_p$ values of $R_1$ and $R_2$ is 0.65 or more. The sum of the $\sigma_p$ values of $R_1$ and $R_2$ is preferably 0.70 or more and the preferred upper limit thereof is about 1.8.

$R_1$, $R_2$ and $R_3$ is each an the electron attractive group having the $\sigma_p$ value of 0.20 or more, preferably 0.35 or more, and more preferably 0.60 or more. The upper limit thereof is 1.0. The Hammett's rule is the rule of thumb proposed by L. P. Hammett in 1935 in order to quantitatively discuss the affects exerted to a reaction or equilibrium of a benzene derivative by a substituent. In these days, the term is widely understood.

The $\sigma_p$ value and $\sigma_m$ value are available as the substituent constant obtained according to the Hammett's rule and the values thereof are described in many general publications. They are described in, for example, *Lange's Handbook Of Chemistry,* 12th edition, edited by J. A. Dean, 1979 (McGrow-Hill) and *Chemical Region, Extra Edition* No. 122, pp. 96 to 103, 1979 (Nankohdo). In the present invention, $R_1$, $R_2$ and $R_3$ are regulated by Hammett's substituent constant $\sigma_p$ value, but this does not mean that they are limited to the substituents the $\sigma_p$ values of which are described in these publications. Even if the $\sigma_p$ values of the groups are not described in the publications, they are naturally included in the scope of the present invention as long as they are included in the above range when they are measured according to the Hammett's rule.

There can be enumerated as examples of $R_1$, $R_2$ and $R_3$ which are the electron attractive groups having $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a dialkylphosphinyl group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with other electron attractive group having the $\sigma_p$ value of 0.20 or more, a heterocyclic group, a halogen atom, an azo group, and a selenocyanate group. Of these substituents, the groups capable of further having substituents may further have the substituents given the groups exemplified for $R_4$.

To describe $R_1$, $R_2$ and $R_3$ in more detail, there can be enumerated as the electron attractive groups having $\sigma_p$ values of 0.20 or more, an acyl group (for example, acetyl, 3-phenylpropanoyl, benzoyl, and 4-dodecyloxybenzoyl), an acyloxy group (for example, acetoxy), a carbamoyl group (for example, carbamoyl, N-ethylcarbamoyl, N-phenylcarbamoyl, N,N-dibutylcarbamoyl, N-(2-dodecyloxyethyl) carbamoyl, N-(4-n-pentadecanamide) phenylcarbamoyl, N-methyl-N-dodecylcarbamoyl, and N-[3-(2,4-di-t-amylphenoxy)propyl]carbamoyl), an alkoxycarbonyl group (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, octadodecyloxycarbonyl, diethylcarbamoylethoxycarbonyl, perfluorohexylethoxycarbonyl, and 2-decylhexyloxycarbonylmethoxycarbonyl), an aryloxycarbonyl group (for example, phenoxycarbonyl and 2,5-amylphenocycarbonyl), a cyano group, a nitro group, a di-alkylphosphono group (for example, dimethylphosphono), a diarylphosphono group (for example, diphenylphosphono), a dialkoxyphospholyl group (for example, dimethoxyphospholyl), a dialkylphosphinyl group (for example, dimethylphosphinyl), a diarylphosphinyl group (for example, diphenylphosphinyl), an alkylsulfinyl group (for example, 3-phenoxypropylsulfinyl), an arylsulfinyl group (for example, 3-pentadecylphenylsulfinyl), an alkylsulfonyl group (for example, methanesulfonyl and octanesulfonyl), an arylsulfonyl group (for example, benzenesulfonyl and toluenesulfonyl), a sulfonyloxy group (for example, methanesulfonyloxy and toluenesulfonyloxy), an acylthio group (for example, acetylthio and benzoylthio), a sulfamoyl group (for example, N-ethylsulfamoyl, N,N-dipropylsulfamoyl, N-(2-dodecyloxyethyl) sulfamoyl, N-ethyl-N-dodecylsulfamoyl, and N,N-diethylsulfamoyl), a thiocyanate group, a thiocarbonyl group (for example, methylthiocarbonyl and phenylthiocarbonyl), a halogenated alkyl group (for example, trifluoromethyl and heptafluoropropyl), a halogenated alkoxy group (for example, trifluoromethyloxy), a halogenated aryloxy group (for example, pentafluorophenyloxy), a halogenated alkylamino group (for example, N,N-di-(trifluoromethyl) amino), a halogenated alkylthio group (for example, difluoromethylthio and 1,1,2,2-tetra-fluoroethylthio), an aryl group substituted with other electron attractive groups having a $\sigma_p$ value of 0.20 or more (for example, 2,4-dinitrophenyl, 2,4,6-trichlorophenyl, and pentachlorophenyl), a heterocyclic group (for example, 2-benzoxazolyl, 2-benzothiazolyl, 1-phenyl-2-benzimidazolyl, pyrazolyl, 5-chloro-1-tetra-azolyl, and 1-pyrrolyl), a halogen atom (for example, a chlorine atom and a bromine atom), an azo group (for example, phenylazo), and a selenocyanate group.

To enumerate representative $\sigma_p$ values of the electron attractive groups, they include a cyano group (0.66), a nitro group (0.78), a trifluoromethyl group (0.54), an acetyl group (0.50), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), a pyrazolyl group (0.37), a methanesulfonyloxy group (0.36), a dimethoxyphospholyl group (0.60), and a sulfamoyl group (0.57).

There can be enumerated as the preferred $R_1$, $R_2$ and $R_3$ groups, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group. Further preferred are an acyl group, an alkoxycarbonyl group, an aryloxycarbonyl group, a nitro group, a cyano group, an arylsulfonyl group, a carbamoyl group, and a halogenated alkyl group. Even more preferred are a cyano group, an alkoxycarbonyl group, an aryloxycarbonyl group, and a halogenated alkyl group.

Particularly preferred are a cyano group; a trifluoromethyl group; a straight or branched unsubstituted alkoxycarbonyl group; an alkoxycarbonyl group substituted with a carbonyl group; and ether linkage-containing alkoxycarbonyl group; an unsubstituted aryloxycarbonyl group; and an aryloxycarbonyl group substituted with alkyl or alkoxy groups.

The combination of $R_1$ and $R_2$ is preferably one in which $R_1$ is a cyano group and $R_2$ is a trifluoro methyl group; a cyano group; a trifluoromethyl group; a straight or branched unsubstituted alkoxycarbonyl group; an alkoxycarbonyl group substituted with a carbonyl group; an ether linkage-containing alkoxycarbonyl group; an unsubstituted aryloxycarbonyl group; and an aryloxycarbonyl group substituted with alkyl or alkoxy groups.

$R_4$ represents a hydrogen atom or a substituent (including an atom other than hydrogen). There can be enumerated as the substituent, a halogen atom, an aliphatic group, an aryl group, a heterocyclic group, an alkoxy group, an aryloxy group, a heterocyclic oxy group, an alkyl, aryl or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl, aryl or heterocyclic acyl group, an alkyl, aryl or heterocyclic sulfonyl group, an alkyl, aryl or heterocyclic sulfinyl group, an alkyl, aryl or heterocyclic oxy carbonyl group, an alkyl, aryl or heterocyclic oxy carbonylamino group, a sulfonamide group, a carbamoyl group, a sulfamoyl group, a phosphonyl group, a sulfamide group, an imido group, an azolyl group, a hydroxy group, a cyano group, a carboxy group, a nitro group, a sulfo group, and an unsubstituted amino group. The alkyl group, aryl group or heterocyclic group contained in these groups may further be substituted with the substituents exemplified for $R_4$.

To be more detailed, $R_4$ represents a hydrogen atom, a halogen atom (for example, a chlorine atom and a bromine atom), an aliphatic group (for example, a linear or branched alkyl group having a carbon number of 1 to 36, an aralkyl group, an alkenyl group, an alkynyl group, a cycloalkyl group, and a cycloalkenyl group, and to be detailed, for example, methyl, ethyl, propyl, isopropyl, t-butyl, tridecyl, 2-methanesulfonylethyl, 3-(3-pentadecylphenoxy)propyl, 3-[4-{2-[4-(4-hydroxyphenylsulfonyl)phenoxy]dodecanamide}phenyl]propyl, 2-ethoxytridecyl, trifluoromethyl, cyclopentyl, and 3-(2,4-di-t-amylphenoxy)propyl), an aryl group (preferably having a carbon number of 6 to 36, for example, phenyl, naphthyl, 4-hexadecyloxyphenyl, 4-t-butylphenyl, 2,4-di-t-amylphenyl, 4-tetradecanamidophenyl, and 3-(2,4-tert-amylphenoxyacetoamide)phenyl), a heterocyclic group (for example, 3-pyridyl, 2-furyl, 2-thienyl, 2-pyridyl, 2-pyrimidinyl, and 2-benzothiazolyl), an alkoxy group preferably having a carbon number of 32 or less (including a carbon number of substituents) (for example, methoxy, ethoxy, 2-methoxyethoxy, 2-dodecyloxyethoxy, and 2-methanesulfonylethoxy), an aryloxy group preferably having a carbon number of 32 or less (including a carbon number of substituents) (for example, phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, and 3-methoxycarbamoylphenoxy), a heterocyclic oxy group (for example, 2-benzimidazolyloxy, 1-phenyltetrazole-5-oxy, and 2-tetrahydropyranyloxy), an alkyl, aryl or heterocyclic thio group (for example, methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetra-decaneamidophenylthio, 2-benzothiazolylthio, 2,4-diphenoxy-1,3,4-triazole-6-thio, and 2-pyridylthio), an acyloxy group (for example, acetoxy and hexadecanoyloxy), a carbamoyloxy group (for example, N-ethylcarbamoyloxy and N-phenylcarbamoyloxy), a silyloxy group (for example, trimethylsilyloxy and dibutylmethylsilyloxy), a sulfonyloxy group (for example, dodecylsulfonyloxy), an acylamino group (for example, acetoamido, benzamido, tetradecaneamido, 2-(2,4-tert-amylphenoxy)acetoamido, 2-[4-(4-hydroxyphenylsulfonyl)phenoxy]decaneamido, isopentadecaneamido, 2-(2,4-di-t-amylphenoxy) butaneamido, and 4-(3-t-butyl-4-hydroxyphenoxy) butaneamido), an alkylamino group (for example, methylamino, butylamino, dodecylamino, dimethylamino, diethylamino, and methylbutylamino), an arylamino group (for example, phenylamino, 2-chloroanilino, 2-chloro-5-tetradecaneamidoanilino, N-acetylanilino, 2-chloro-5-[α-2-tert-butyl-4-hydroxyphenoxy)dodecaneamido] anilino, and 2-chloro-5-dodecyloxycarbonylanilino), a ureido group (for example, methylureido, phenylureido, N,N-dibutylureido, and dimethylureido), a sulfamoylamino group (for example, N,N-dipropylsulfamoylamino and N-methyl-N-decylsulfamoylamino), an alkenyloxy group (for example, 2-propenyloxy), a formyl group, an alkyl, aryl or heterocyclic acyl group (for example, acetyl, benzoyl, 2,4-di-tert-amylphenylacetyl, 3-phenylpropanoyl, and 4-dodecyloxybenzoyl), an alkyl, aryl or heterocyclic sulfonyl group (for example, methanesulfonyl, octanesulfonyl, benzenesulfonyl, and toluenesulfonyl), an alkyl, aryl or heterocyclic sulfinyl group (for example, octanesulfinyl, dodecanesulfinyl, phenylsulfinyl, 3-pentadecylphenylsulfinyl, and 3-phenoxypropylsulfinyl), an alkyl, aryl or heterocyclic oxy carbonyl group (for example, methoxycarbonyl, butoxycarbonyl, dodecyloxycarbonyl, octadecyloxycarbonyl, phenyloxycarbonyl, and 2-pentadecyloxycarbonyl), an alkyl, aryl or heterocyclic oxy carbonylamino group (for example, methoxycarbonylamino, tetradecyloxycarbonylamino, phenoxycarbonylamino, and 2,4-di-tert-butylphenoxycarbonylamino), a sulfonamide group (for example, methanesulfonamide, hexadecanesulfonamide, benzenesulfonamide, p-toluenesulfonamide, octadecanesulfonamide, and 2-methoxy-5-tert-butylbenzenesulfonamide), a carbamoyl group (for example, N-ethylcarbamoyl, N,N-dibutylcarbamoyl, N-(2-dodecyloxyethyl)carbamoyl, N-methyl-N-dodecylcarbamoyl, and N-[3-(2,4-di-tert-amylphenoxy)propyl]carbamoyl), a sulfamoyl group (for example, N-ethyl-sulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (for example, phenoxyphosphonyl, octyloxyphosphonyl, and phenylphosphonyl), a sulfamido group (for example, dipropylsulfamoylamino), an imido group (for example, N-succinimido, hydantoinyl, N-phthalimido, and 3-octadecenylsuccinimido), an azolyl group (for example, imidazolyl, pyrazolyl, 3-chloropyrazole-1-yl, and triazolyl), a hydroxy group, a cyano group, a carboxy group, a nitro group, a sulfo group, and an unsubstituted amino group.

There can be preferably enumerated as $R_4$, an alkyl group, an aryl group, a heterocyclic group, a cyano group, a nitro group, an acylamino group, an arylamino group, a ureido group, a sulfamoylamino group, an alkylthio group, an arylthio group, a heterocyclic thio group, an alkoxycarbonylamino group, an aryloxycarbonylamino group, a sulfonamide group, a carbamoyl group, a sulfamoyl group, a sulfonyl group, an alkoxycarbonyl group, an aryloxycarbonyl group, a heterocyclic oxy group, an acyloxy group, a carbamoyloxy group, an imido group, a sulfinyl group, a phosphonyl group, an acyl group, and an azolyl group.

Further preferred are an alkyl group and an aryl group. Even more preferred is an alkyl group or aryl group having at least one alkoxy group, sulfonyl-group, sulfamoyl group, carbamoyl group, acylamide group, or sulfonamide group as a substituent. Particularly preferred is an alkyl group or aryl group having at least one acylamido group or sulfonamido group as a substituent.

In Formula (Ia), X represents a hydrogen atom or a group (hereinafter referred to as a splitting group) which is split off when a coupler reacts with an oxidation product of an organic primary amine color developing agent. When X represents an splitting group, the splitting group is a halogen atom; an aromatic azo group; an alkyl group, an aryl group, a heterocyclic group, an alkyl- or arylsulfonyl group, an arylsulfinyl group, an alkoxy, aryloxy or heterocyclic oxy carbonyl group, an aminocarbonyl group, or an alkyl, aryl or heterocyclic carbonyl group each bonded to a coupling site via an oxygen, nitrogen, sulfur or carbon atom; or a heterocyclic group bonded to the coupling site via a nitrogen atom in the heterocyclic ring. There are given, for example, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl, aryl or heterocyclic thio group, a carbamoylamino group, an arylsulfinyl group, an arylsulfonyl group, a 5-membered or 6-membered nitrogen-containing heterocyclic group, an imido group, and an arylazo group. The alkyl group, aryl group or heterocyclic group contained in these splitting groups may further be substituted with the substitutents enumerated for $R_4$. When these substituents are two or more, they may be the same or different. These groups may further have the substituents enumerated for $R_4$.

To be more detailed, the splitting group is a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzoyloxy), an alkyl- or arylsulfonyloxy group (for example, methanesulfonyloxy and toluenesulfonyloxy), an acylamino group (for example, dichloroacetylamino and heptafluorobutylylamino), an alkyl- or arylsulfonamido group (for example, methanesulfonamino, trifluoromethanesulfonamino, and p-toluenesulfonylamino), an alkoxycarbonyloxy group (for example, ethoxycarbonyloxy and benzyloxycarbonyloxy), an aryloxycarbonyloxy group (for example, phenoxycarbonyloxy), an alkyl, aryl or heterocyclic thio group (for example, ethylthio, 2-carboxyethylthio, dodecylthio, 1-carboxydodecylthio, phenylthio, 2-butoxy-5-t-octylphenylthio, and tetrazolylthio), an arylsulfonyl group (for example, 2-butoxy-5-tert-octylphenylsulfonyl), an arylsulfinyl group (for example, 2-butoxy-5-tert-octylphenylsulfinyl), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and, 1,2-dihydro-2-oxo-1-pyridyl), an imido group (for example, succinimido and hydantoinyl), and an arylazo group (for example, phenylazo and 4-methoxyphenylazo). These groups may further be naturally substituted with the substitutents enumerated for $R_4$. There is available as a splitting group bonded via a carbon atom, a bis type coupler which can be obtained by condensing a tetraequivalent coupler with aldehydes and ketones. The splitting group according to the present invention may contain a photographically useful group such as a development inhibitor or a development accelerator.

X is preferably a halogen atom, an alkoxy group, an aryloxy group, an alkyl- or arylthio group, an arylsulfonyl group, an arylsulfinyl group, or a 5-membered or 6-membered nitrogen-containing heterocyclic group bonded to a coupling active site via the nitrogen atom. X is more preferably an arylthio group.

In the cyan coupler represented by Formula (Ia), the group represented by $R_1$, $R_2$, $R_3$, $R_4$ or X may contain a cyan coupler residue represented by Formula (Ia) to form a polymer higher than a dimer, or the group represented by $R_1$, $R_2$, $R_3$, $R_4$ or X may contain a high molecular chain to form a homopolymer or a copolymer. The homopolymer or copolymer containing the high molecular chain is an addition polymer having the cyan coupler residue represented by Formula (Ia). A typical example thereof is a homopolymer or copolymer of an ethylene type unsaturated compound. In this case, one or more kinds of a cyan color development repetitive unit having a cyan coupler residue represented by Formula (Ia) may be contained in the polymer and one or more kinds of a non-color developable ethylene type monomer such as acrylic acid ester, methacrylic acid ester, and maleic acid ester, which is not subject to coupling with the oxidation product of an aromatic primary amine developing agent, may be contained in the polymer as a copolymerization component.

Examples of the coupler of the present invention are shown below but the present invention is not limited thereto:

(1)
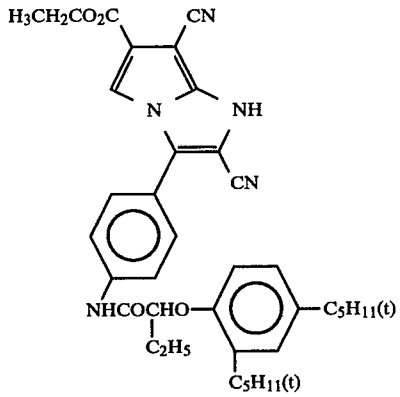
(2)
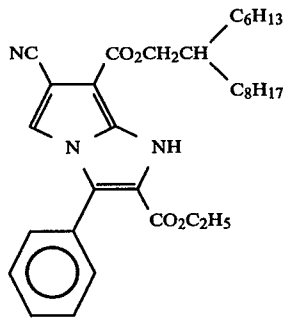

-continued
(3)
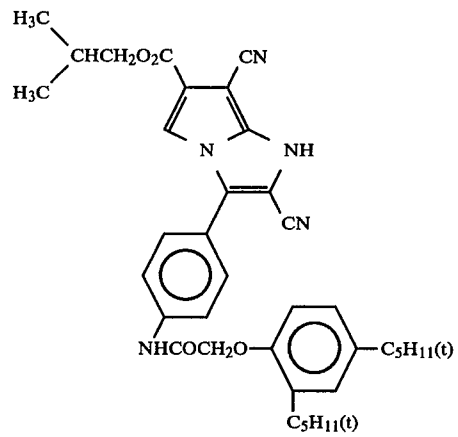
(4)
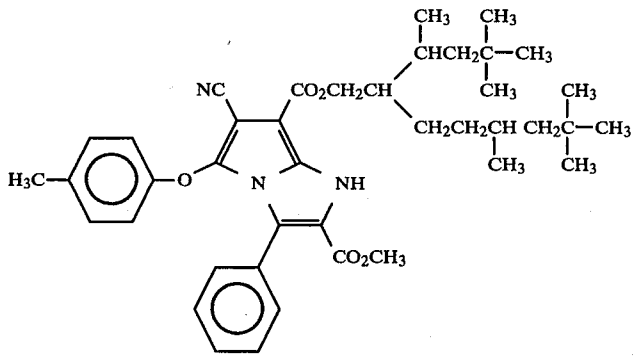

-continued
(5)
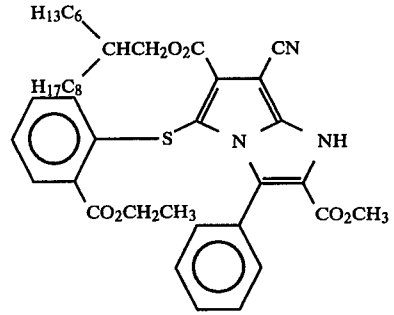
(6)
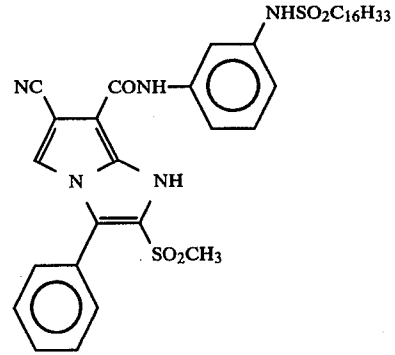
(7)
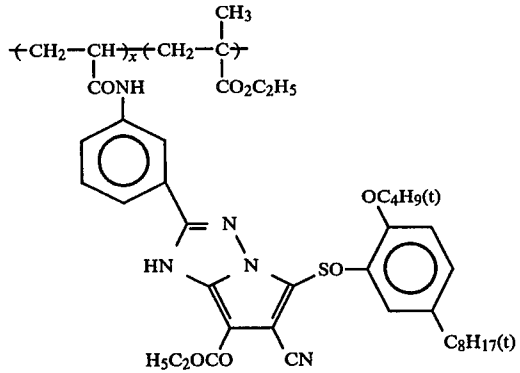
X:Y = 50:50 (mol ratio)

-continued
| No. | $R_1$ | $R_2$ | $R_4$ | X |
|---|---|---|---|---|
| | | 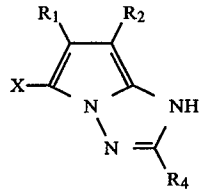 | | |
| (8) | $CO_2CH_3$ | CN | 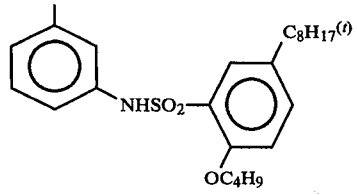 | H |
| (9) | CN | 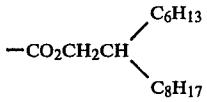 | 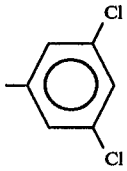 | H |
| (10) | CN | 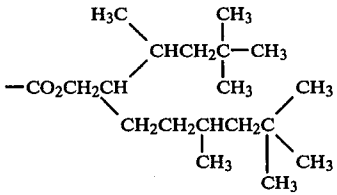 | 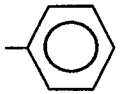 | H |
| (11) | CN | 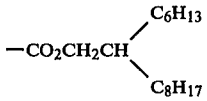 | 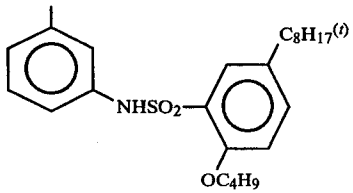 | H |

-continued
| | | | | |
|---|---|---|---|---|
| (12) | CN | 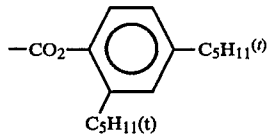 | 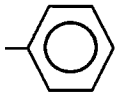 | H |
| (13) | CN | 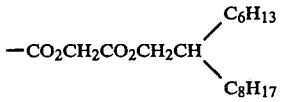 | 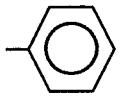 | H |
| (14) | CN | $-CO_2CH_2CH_2(CF_2)_6F$ | 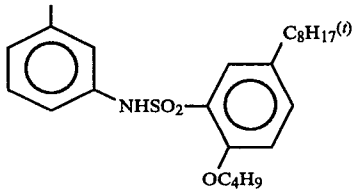 | H |
| (15) | CN | 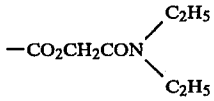 | 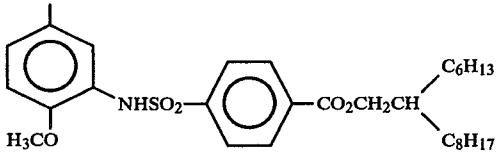 | 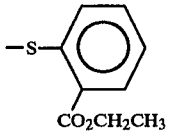 |
| (16) | CN | $-CO_2CH_2CH_2(CF_2)_6F$ | 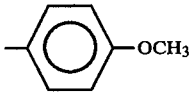 | 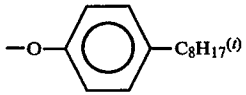 |
| (17) | CN | 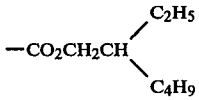 | 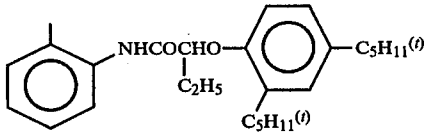 | 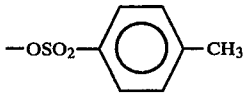 |

-continued
| | | | | |
|---|---|---|---|---|
| (18) | CN | 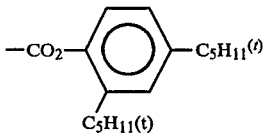 | 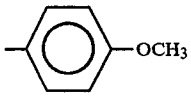 | 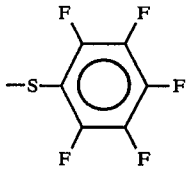 |
| (19) | CN | 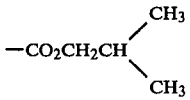 | 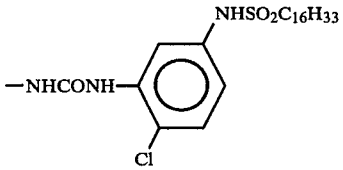 | 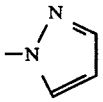 |
| (20) | CN | $-CO_2CH_2(CF_2)_4H$ | 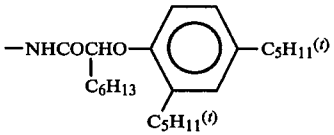 | 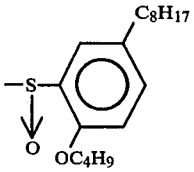 |
| (21) | CN | 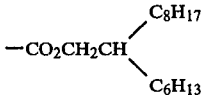 | 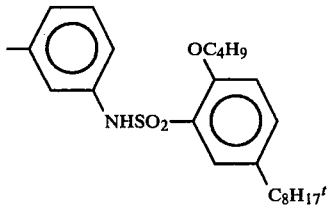 | H |
| (22) | 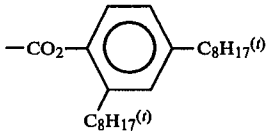 | CN | 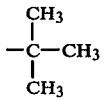 | 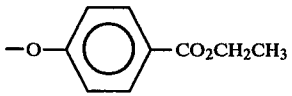 |
| (23) | $-CO_2CH_2C_6F_{13}$ | CN | 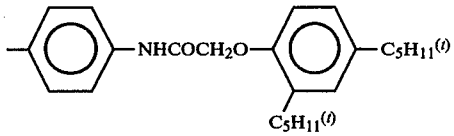 | Cl |

-continued
| | | | | |
|---|---|---|---|---|
| (24) | 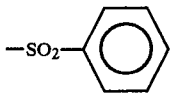 | 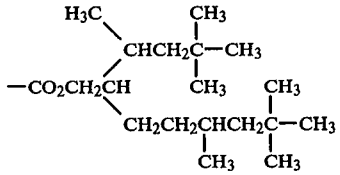 | $CH_3$ | $-OCOCH_3$ |
| (25) | CN | $-CO_2CH_2CO_2CH_3$ | 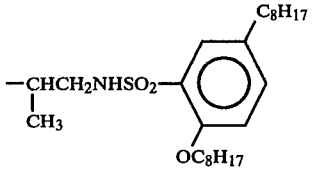 | 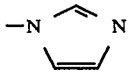 |
| (26) | CN | 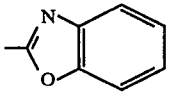 | 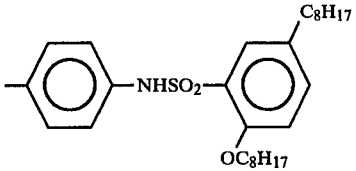 | 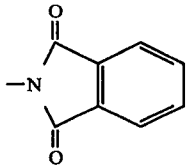 |
| (27) | CN | $CF_3$ | 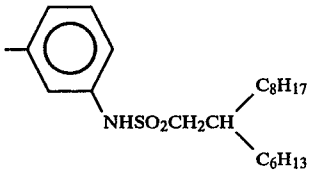 | Cl |
| (28) | 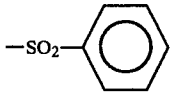 | $CF_3$ | 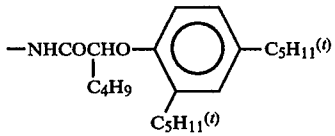 | F |
| (29) | CN | 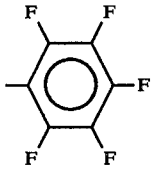 | 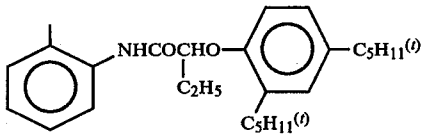 | 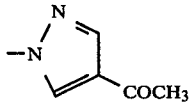 |

-continued
| | | | | |
|---|---|---|---|---|
| (34) | $-CO_2C_2H_5$ | CN | 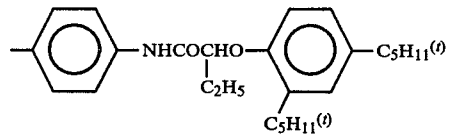 | Cl |
| (35) | CN | 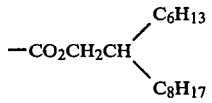 | 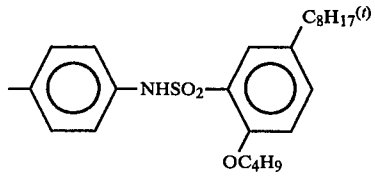 | H |
| (36) | CN | $-CO_2CH_2CH_2(CF_2)_6F$ | 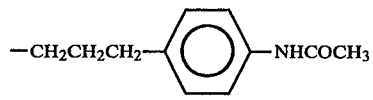 | 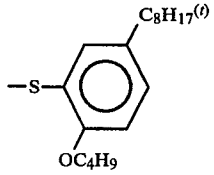 |
| (37) | CN | 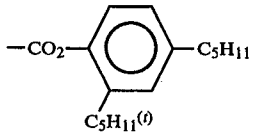 | 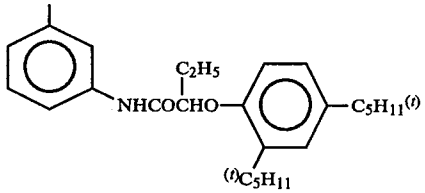 | 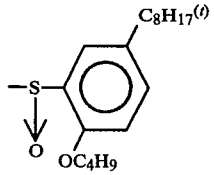 |
| (38) | CN | 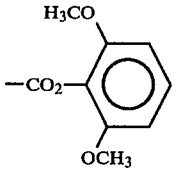 | 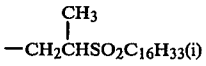 | 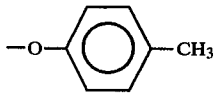 |

-continued
| | | | | |
|---|---|---|---|---|
| (30) | 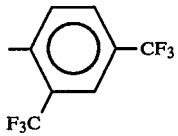 | $-SO_2Ph$ | 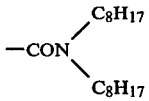 | 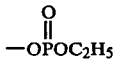 |
| (31) | CN | 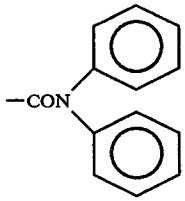 | 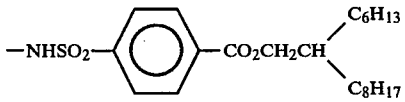 | 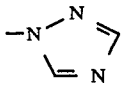 |
| (32) | CN | 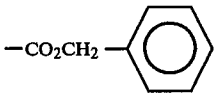 | 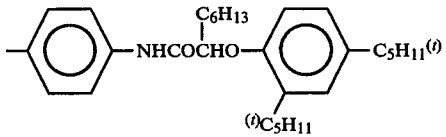 | H |
| (33) | CN | 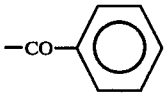 | 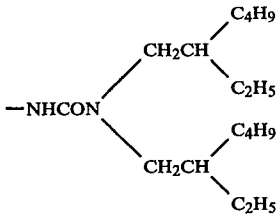 | $-OSO_2CH_3$ |
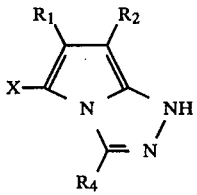

-continued
| | | | | |
|---|---|---|---|---|
| (39) | CN | 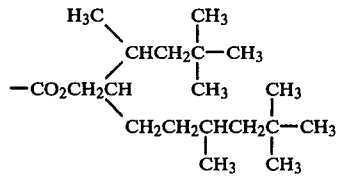 | 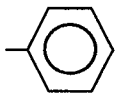 | H |
| (40) | CN | 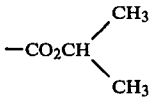 | 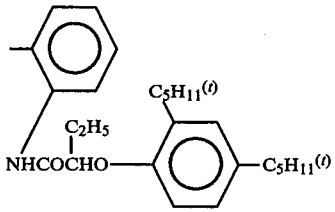 | Cl |
| (41) | CN | 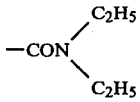 | 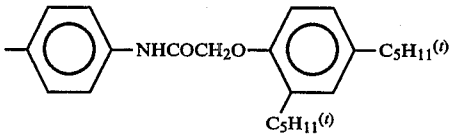 | $-OSO_2CH_3$ |
| (42) | | 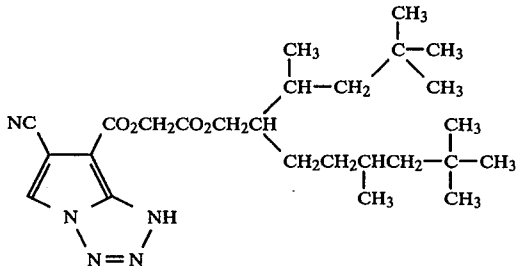 | | |

-continued
(43)
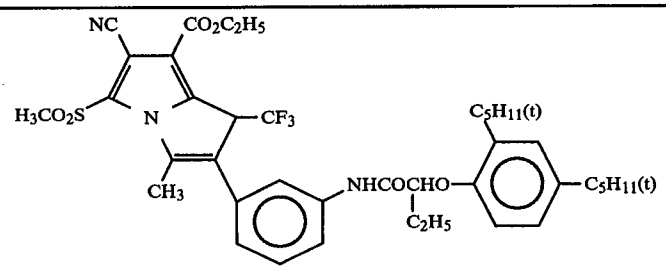
(44)
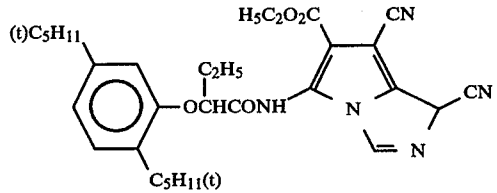
(45)
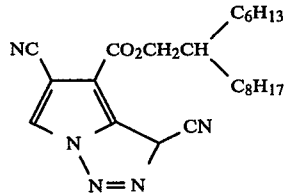
(46)
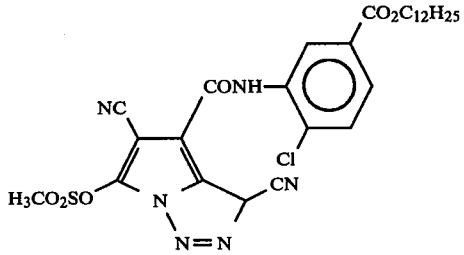

The compound of the present invention and intermediate product thereof can be synthesized by known methods. They can be synthesized according to the methods described in, for example, *J. Am. Chem. Soc.*, No. 80, 5332 (1958), *J. Am. Chem. Soc.*, No. 81, 2452 (1959), *J. Am. Chem. Soc.*, No. 112, 2465 (1990), *Org. Synth.*, I, 270 (1941), *J. Chem. Soc.*, 5149 (1962), *Heterocycles*, No. 27, 2301 (1988), and *Rec. Tray. Chim.*, 80, 1075 (1961), the publications cited therein, or the methods equivalent thereto.

Synthetic Example 1: synthesis of the exemplified Coupler (9)

The exemplified Coupler (9) was synthesized via the following route:

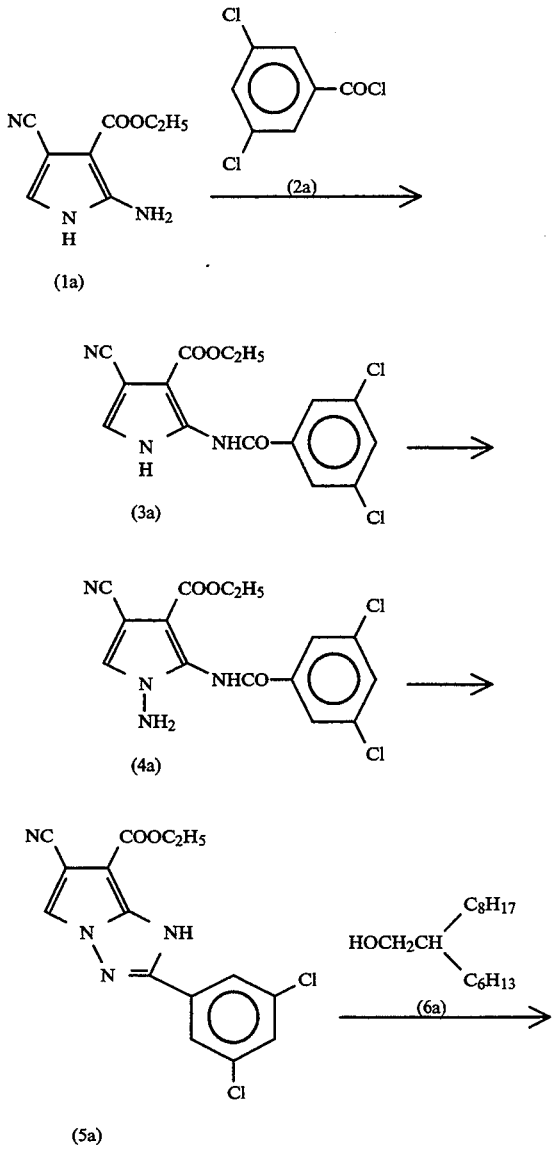

-continued

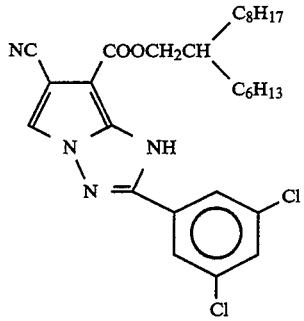

Exemplary Coupler (9)

Added to a dimethylacetamide (300 ml) solution of 2-amino-4-cyano-3-methoxycarbonylpyrrole (1a) (66.0 g, 0.4 mole) was 3,5-dichlorobenzoyl chloride (2a) (83.2 g, 0.4 mole) at a room temperature, and stirring was applied for 30 minutes. Water was added and the solution was extracted twice with ethyl acetate. An organic phase was collected and washed with water and a saturated salt aqueous solution, followed by drying on sodium sulfate anhydrous. The solvent was distilled off under a reduced pressure and the residue was recrystallized from acetonitrile (300 ml), whereby compound (3a) (113 g, 84%) was obtained.

The powder of potassium hydroxide (252 g, 4.5 mole) was added to the dimethylformamide (200 ml) solution of compound (3a) (101.1 g, 0.3 mole) at room temperature and stirred well. While cooling with water, hydroxylamine-o-sulfonic acid (237 g, 2.1 mole) was added little by little taking care so that the temperature did not suddenly rise, and after completing the addition, the solution was stirred for 30 minutes. A 0.1N hydrochloric acid aqueous Solution was dropped to neutralize the solution with a pH test paper. The solution was extracted three times with ethyl acetate. An organic phase was washed with water and a saturated salt aqueous solution and then dried on sodium sulfate anhydrous. The solvent was distilled off under a reduced pressure and the residue was refined with a column chromatography (a spreading solvent, hexane:ethyl acetate=2:1), whereby compound (4a) (9 g, 9%) was obtained.

Carbon tetrachloride (9 ml) was added to the acetonitrile (30 ml) solution of compound (4a) (7.04 g, 20 mmole) at room temperature and subsequently triphenyl phosphine (5.76 g, 22 mmole) was added, followed by heating for refluxing for 8 hours. After cooling down, water was added and the solution was extracted with ethyl acetate three times. An organic phase was washed with water and a saturated salt aqueous solution and then dried on sodium sulfate anhydrous. The solvent was distilled off under a reduced pressure and the residue was refined with silica gel column chromatography (a spreading solvent, hexane: ethyl acetate=4:1), whereby compound (5a) (1.13 g, 17%) was obtained.

Compound (5a) thus obtained (1.8 g) and the compound (6a) (12.4 g) were dissolved in sulfolane (2.0 ml), and further titanium isopropoxide (1.5 g) was added thereto. The reaction was carried out for 1.5 hours while maintaining the reaction temperature at 110° C. and then ethyl acetate was added, followed by washing with water. After the ethyl acetate phase was dried, the solvent was distilled off and the residue was refined with column chromatography, whereby exemplified Coupler (9) 1.6 g was obtained. The melting point thereof was 97° to 98° C.

Where the cyan coupler of the present invention is applied to a silver halide color light-sensitive material, the material may have one or more layers containing the coupler of the present invention on a support. The layer containing the coupler of the present invention may be a hydrophilic layer provided on the support. In general, the color light-sensitive material can be of the constitution in which a blue-sensitive silver halide emulsion layer, a green-sensitive silver halide emulsion layer, and a red-sensitive silver halide emulsion layer are coated in this order on a support, but the order may be different from this. Further, at least one of the above light-sensitive emulsion layers can be replaced with an infrared-sensitive silver halide emulsion layer. The silver halide emulsions having sensitivities in the respective wavelength regions and couplers forming dyes having a relationship of a complementary color with the rays to which the emulsions are sensitive can be contained in these light-sensitive emulsion layers to carry out color reproduction by a subtractive color process. Provided that the invention includes layer constitutions in which the light-sensitive emulsion layers do not have the relationship mentioned above with the hues of the dyes developed with the couplers.

Where the coupler of the present invention is applied to the light-sensitive material, it is used particularly preferably in a red-sensitive silver halide emulsion layer.

The addition amount of the coupler of the present invention to a light-sensitive material is usually $1\times10^{-3}$ to 1 mole, preferably $2\times10^{-3}$ to $5\times10^{-1}$ mole, per mole of silver halide.

The preferred coating amount of the cyan coupler of the present invention is $2.0\times10^{-6}$ to $2.0\times10^{-3}$ mole, further preferably $2.0\times10^{-5}$ to $1.0\times10^{-3}$ mole per $m^2$ of the light-sensitive material. The cyan coupler of the present invention can be mixed with cyan couplers other than those of the present invention, but the proportion of the cyan coupler of the present invention is preferably 5 mole% or more, further preferably 30 mole % or more. The coated amount of silver halide contained in the cyan color developing emulsion layer is preferably 0 05 to 0.50 $g/m^2$ further preferably 0.07 to 0.30 $g/m^2$ in terms of the amount converted to silver.

In the present invention, various known techniques can be applied in order to add the above coupler to a light-sensitive material. Usually, it can be added according to the oil-in-water dispersion method known as an oil protect method, in which the coupler is dissolved in a solvent and then emulsified and dispersed in a gelatin aqueous solution containing a surface active agent, or water or a gelatin aqueous solution is added to a coupler solution containing a surface active agent to prepare an oil-in-water dispersion accompanied with a phase conversion. An alkali soluble coupler can be separated also by a socalled Fisher dispersion method. After removing a low boiling organic solvent from a coupler dispersion by distillation, noodle washing or a ultrafiltration, the dispersion may be mixed with a photographic emulsion.

There can be preferably used as the dispersing medium for the coupler, a high boiling organic solvent having a dielectric constant (25° C.) of 2 to 20 and a refraction index (25° C.) of 1.5 to 1.7 and/or a water insoluble high molecular compound, In the present invention, the ratio (by weight) of the dispersing medium to the coupler is preferably 0.1 to 10, further preferably 2 to 7.

In providing a substantially non-light-sensitive hydrophilic colloid layer containing a white pigment on a support, which is one embodiment of the present invention, the density of the white pigment in the hydrophilic colloid layer containing the white pigment is 20 weight % or more, preferably 40 weight % or more, and most preferably 70 weight % or more. The upper limit of this density is not specifically limited but it is preferably 99 weight %. The above term "substantially non-light-sensitive" means that the layer does not substantially work on in image formation. The density described in-the present invention is the ratio of the weight of the white pigment to the sum of the weights of the white pigment and hydrophilic binder contained in the hydrophilic colloid layer. Where the white pigment contains various surface treatment agents or dispersion stabilizers for the purpose of improving the dispersing performance thereof, the weight thereof is included in the weight of the white pigment described in the present invention.

The coated amount of the white pigment is preferably 2 $g/m^2$ or more, more preferably 4 $g/m^2$ or more, and further more preferably 8 $g/m^2$ or more. The upper limit thereof is not specifically limited, but it is preferably 40 $g/m^2$.

The thickness of the hydrophilic colloid layer containing the white pigment can be determined by the above content and coated amount and it falls preferably within the range of 0.5 to 10 μm, more preferably 2 to 5 μm.

There can be enumerated as the white pigment used in the present invention, titanium dioxide, barium sulfate, litopon, alumina white, calcium carbonate, silica white, antimony trioxide, titanium phosphate, zinc oxide, white lead, and gypsum. Among these pigments, the use of titanium dioxide is particularly effective. Titanium dioxide may be either of the rutile type or the anatase type and may be manufactured by either a sulfate process or a chloride process.

The grain size of the white pigment used in the hydrophilic colloid layer is 0.1 to 1.0 μm, preferably 0.2 to 0.3 μm, in terms of an average grain size.

In the present invention, gelatin can be preferably used as a hydrophilic colloid (i.e., a binder) constituting the hydrophilic colloid layer containing the white pigment, a silver halide emulsion layer and a non-light-sensitive intermediate layer. Other hydrophilic colloids can be used as well in place of gelatin in proportion according to necessity.

There can be enumerated as examples thereof, the synthetic polymers spread over a wide range including a gelatin derivative, a graft polymer of gelatin with other polymers, protein such as albumin and casein, a cellulose derivative (for example, hydroxyethyl cellulose, carboxymethyl cellulose and cellulose sulfate), saccharides such as sodium alginate and starch, polyvinyl alcohol, a partially acetalized product of polyvinyl alcohol, poly(N-vinylpyrrolidone), polyacrylic acid, polymethacrylic acid, polyacrylamide, polyvinylimidazole, and polyvinylpyrazole.

In the present invention, various materials used for a photographic light-sensitive material can be added to the white pigment-containing hydrophilic colloid layer in addition to the white pigment and binder. They include, for example, a surface active agent as a coating aid, a hardener, a dye, and an anti-fogging agent. Further, a high boiling organic solvent dispersed on a fine oil drop can be incorporated. When the dispersion of the high boiling organic solvent is added, various oil soluble materials (such as a fluorescent whitening agent) dissolved therein can be incorporated.

The light-sensitive material of the present invention comprises a support and provided thereon at least one light-sensitive emulsion layer and a hydrophilic colloid layer containing a white pigment, and in addition an optional non-light-sensitive layer such as an anti-color mixing layer or a protective layer.

In the present invention, the hydrophilic colloid layer containing the white pigment is provided between the support and light-sensitive emulsion layer.

There can be enumerated as the support provided thereon with the hydrophilic colloid layer containing the white pigment, paper consisting of a natural pulp and a synthetic pulp, a baryta paper, a resin-coated paper covered with polyolefin such as polyethylene or polyester, a synthetic high molecular film of polyethylene, polypropylene, polystyrene, polycarbonate, hard polyvinyl chloride, and polyethylene terephthalate, and a natural high molecular film of cellulose diacetate, cellulose triacetate and nitrocellulose. The support has preferably a waterproof property from the viewpoint of acceleration of development processing of the light-sensitive material. That is, a waterproof resin-coated paper or a high molecular film is preferably used. Further, a support having a surface with a diffuse reflectivity of the second kind can be used as well. The diffuse reflectivity of the second kind means a diffuse reflectivity obtained by giving the projections on the surface having a mirror surface to divide it in to the mirror surfaces turned in different directions and diffusing the directions of the divided fine surfaces (i.e., the mirror surfaces). The projections on the surface of the diffuse reflectivity of the second kind have a three dimensional average roughness to a central face of 0.1 to 2 μm, preferably 0.1 to 1.2 μm. The frequency on the projections on the surface is preferably 0.1 to 2000 cycles/mm, more preferably 50 to 600 cycles/mm, in the projections having the roughness of 0.1 μm or more. The details of such supports are described in JP-A-2-239244.

The present invention includes an embodiment in which a white pigment is incorporated only into a hydrophilic colloid layer so that it is not incorporated into the resin constituting the support, for example, a resin coated on a paper substrate or a resin film which is a support itself. In another embodiment, the white pigment is incorporated into the hydrophilic colloid layer and it is incorporated as Well into the resin constituting the above support.

A light-sensitive emulsion layer may be provided directly on the layer above the hydrophilic colloid layer containing the white pigment, or it may be provided thereon via a plurality of non-light-sensitive hydrophilic colloid layers. Where these non-light-sensitive hydrophilic colloid layers are provided, the sum of the thickness of these layers is preferably 5 μm or less, more preferably 2 μm or less. Various photographically useful materials can be incorporated into these non-light-sensitive hydrophilic colloid layers according to necessity. They are, for example, a surface active agent as a coating aid, a hardener, a dye, and an anti-fogging agent. Further, colloidal silver, a dye dispersed in the form of a solid matter, or a dye mordanted on a cationic polymer is preferably incorporated to form a coloring layer that can be decolored in a development processing step. Or, a high boiling organic solvent dispersed in the form of a fine oil drop can be incorporated as well. The photographically useful materials such as an oil soluble anti-color mixing agent, a fluorescent whitening agent and a UV absorber can be dissolved in this solvent and incorporated.

In the present invention, in addition to the above technique of white pigment,.the provision of a coloring layer capable of being decolored in a development processing at any site of the hydrophilic colloid layers provided on the light-sensitive layer side on a support can further improve sharpness.

In other embodiments of the present invention, it is required to use a support in which the density of the white pigment contained in a waterproof resin layer coated on the side of a paper substrate on which a silver halide emulsion layer is provided is 15 weight % or more. The density of the white pigment is preferably 20 weight % or more. The upper limit of the density is not specifically limited, but it is preferably 90 weight % in order to form an even layer.

The pigments such as titanium dioxide are applied preferably after the surfaces of the fine grains thereof have been subjected to a surface treatment with di- to tetrahydric alcohols, for example, 2,4-dihydroxy-2-methylpentane and trimethylolethane described in JP-A-58-17151, together with or independently from an inorganic oxide such as silica and aluminum oxide. In such the case, the weight of the white pigment is calculated with the value including these surface treatment materials.

The waterproof resin layer containing white pigment fine particles such as titanium dioxide is used in the thickness of 3 to 200 μm, preferably 5 to 80 μm.

The waterproof resin layer containing the white pigment fine particles such as titanium dioxide according to the present invention may be laminated with a plurality of the waterproof resin layers such as, for example, a layer having a different density of white pigment, a layer containing different white pigment and a layer containing no white pigment at all. In such the case, the waterproof resin layer containing the white pigment fine particles such as titanium dioxide according to the present invention is preferably provided on the side farther from a support.

In the present invention, the fluctuation coefficient of the fine particles of the pigment in an occupying area ratio (%) is preferably 0.20 or less, more preferably 0.15 or less, and particularly preferably 0.10 or less.

The dispersibility of the waterproof resin layer containing white pigment fine particles such as titanium dioxide according to the present invention can be evaluated from the occupying area ratio (%) and fluctuation coefficient thereof. The occupying area ratio is obtained by blowing off the resin of a thickness of about 0.1 μm, preferably not much more than 0.05 μm on the resin surface with an ion spattering method by a glow discharge and observing the fine particles of the exposed pigment with an electron microscope. The ion spattering method is described in detail in "Surface Treatment Technique Utilizing a Plasma" written by Y. Murayama and K. Kashiwagi, *Machinery Research*, vol. 33, No. 6 (1981).

In order to control the fluctuation coefficient in the occupying area ratio of the white pigment fine particles to 0.20 or less, the white pigment is suitably kneaded sufficiently in the presence of a surface active agent and preferably used are white pigment fine particle the surfaces of which have been treated with di- to tetrahydric alcohol as described above.

The occupying area ratio (%) per regulated unit area of the white pigment can be most typically obtained by dividing an observed area into unit areas of 6 μm x 6 μm contacting to each other and measuring the occupying area ratio (%) Ri of the pigment fine particles projected on the unit area. The fluctuation coefficient in the occupying area ratio can be obtained in terms of the ratio s/Rm of the standard deviation s of Ri to the average value Rm of Ri. The number (n) of the subject unit areas is preferably 6 or more.

There can be used as the base substrate for the above waterproof resin-covered support in the present invention, a base paper obtained from a natural pulp, a synthetic pulp or a mixture thereof, a polyester film of polyethylene terephthalate and polybutylene terephthalate, and a plastic film of cellulose triacetate, polystyrene and polyolefin.

The above base paper used in the present invention is selected from the materials generally used for a photographic printing paper. That is, there is used a base paper for which a natural pulp selected from a coniferous tree and a broadleaved tree as a main raw material is used and to which there are added according to necessity, a filler such as clay, talc, calcium carbonate and a filler such as urea resin, a sizing agent such as rosin, an alkylketene dimer, a higher fatty acid, paraffin wax and alkenyl succinate, a paper strengthening agent such as polyacrylamide, and a fixing agent such as alum sulfate and a cationic polymer. In particular, preferred is a base paper for which there is used a neutral paper with a pH of 5 or more, in which a reactive sizing agent such as alkylketene dimer and alkenyl succinate is used. It can be judged by measuring with a pH meter in which flat GST-5313 F manufactured by Toa Denpa Industry Co., Ltd. is used for an electrode whether or not the base paper used for a base substrate for a support according to the present invention is a neutral paper. A neutral paper shows a pH value of 5 or more, preferably 5 to 9.

Further, there may be used a base paper in which a synthetic pulp is used in place of the above natural pulp or a base paper in which the pulp obtained by in mixing a natural pulp and a synthetic pulp an arbitrary ratio is used.

This pulp surface can be subjected to a surface sizing treatment with a film-forming polymer such as gelatin, starch, carboxymethyl cellulose, polyacrylamide, and a modified product of polyvinyl alcohol. There can be enumerated as the polyvinyl alcohol-modified product in this case, a carboxyl group-modified product, a silanol-modified product, and a copolymer with acrylamide.

Where the surface sizing treatment is carried out with the film-forming polymer, the coated amount of the film-forming polymer is adjusted to 0.1 to 5.0 g/m$^2$, preferably 0.5 to 2.0 g/m$^2$. Further, in this case, an antistatic agent, a fluorescent whitening agent, a pigment, and a deformer can be added to the film-forming agent according to necessity.

A pulp slurry containing the above pulp, and according to necessity, a filler, a sizing agent, a paper strengthening agent, and a fixing agent is subjected to paper making with a paper machine, drying and rolling up, whereby a base paper is prepared. The above surface sizing treatment is carried out either before or after this drying. A calendering treatment is carried out after the drying until the rolling up. Where the surface sizing treatment is carried out after the drying, this calendering treatment can be carried out either before or after the surface sizing treatment.

The waterproof resin layer of the present invention may itself constitute a support as is the case with a vinyl chloride resin.

There is used for the waterproof resin layer used in the present invention, a resin having a water absorption coefficient (weight %) of 0.5 or less, preferably 0.1 or less at 25° C., for example, polyalkylene (for example, polyethylene, polypropylene and the copolymers thereof), polystyrene, polyacrylate and the copolymers thereof, other vinyl polymers and the copolymers thereof, and polyester and the copolymer thereof. The polyalkylene resin is preferred and there is used low density polyethylene, high density polyethylene, polypropylene, or a blended product thereof. A fluorescent whitening agent, an anti-oxidation agent, an antistatic agent, and a peeling agent are added to the waterproof resin layer according to necessity.

There can be used the unsaturated organic compound having one or more polymerizable carbon—carbon double bonds in one molecule, for example, a methacrylic acid ester series compound, as described in JP-A-57-27257, JP-A-57-49946 or JP-A-61-262738, or tri- or tetraacrylic acid ester represented by the general formula in JP-A-61-262738. In these cases, after titanium dioxide or an other white pigment is dispersed in these unsaturated organic compounds and the dispersion is coated on a base substrate, an electron beam is irradiated thereon for curing, whereby the white pigment-containing waterproof resin layer can be formed. Other resins can be mixed in this resin layer.

There is used as the method for coating the waterproof resin layer according to the present invention, the lamination methods described in *New Laminate Processing Manual* edited by Processing Technique Research Association, for example, dry lamination and non-solvent type dry lamination. A coating method is selected from the methods of a gravure roll type, a wire bar type, a doctor blade type, a reverse roll type, a dipping type, an air knife type, a calender type, a kiss type, a squeeze type, a fountain type, and a coating type.

A support is preferably subjected to a corona discharge treatment, a glow discharge treatment or a flame treatment and is then coated with the hydrophilic colloid layers of a silver halide photographic material.

The basis weight of the support is preferably 30 to 350 g/m$^2$, more preferably 50 to 200 g/m$^2$.

The coloring layer capable of being decolored by a processing used in the present invention may contact directly an emulsion layer and may be provided so that it contacts the emulsion layer via an intermediate layer containing gelatin and an anti-color mixing agent such as hydroquinone. This coloring layer is provided preferably below (i.e., on the support side) the emulsion layer colored to the same kind of elementary color as that of the colored color. It is possible either to independently provide all the coloring layers corresponding to the respective elementary colors or to select only a part thereof and provide it. Further, it is possible as well to provide the coloring layer colored so that it corresponds to a plurality of the elementary color regions. In the optical reflection density in the coloring layer, the optical density in the wavelength in which the optical density is the highest in the visible ray region of 400 to 700 nm in terms of the wavelength of rays is 0.2 to 3.0, more preferably 0.5 to 2.5, and particularly preferably 0.8 to 2.0.

The known methods can be applied to form the coloring layer. They are, for example, the method in which the fine powder of a dye is dispersed in the form of a solid matter, the method in which an anionic dye is mordanted to a cationic polymer, the method in which a dye is adsorbed on a fine particle of silver halide to fix it in a layer, and the method in which colloidal silver is used. There is described at pages 4 to 13 of JP-A-2-308244 as the method in which the fine powder of the dye is dispersed in the form of a solid matter, for example, the method in which there is incorporated a fine powder dye which is substantially insoluble in water at least at a pH of 6 or lower and substantially soluble in water at least at a pH of 8 or higher. Further, the method in which an anionic dye is mordanted to a cationic polymer is described at pages 18 to 26 of JP-A-2-84637. The method for preparing colloidal silver as a photoabsorbing agent is shown in U.S. Pat. Nos. 2,688,601 and 3,459,563. Of these methods, preferred are the method in which the fine powder dye is incorporated and the method in which colloidal silver is used.

The dye fine powder particles can be formed by precipitating the dye in the form of fine particles and/or treating with a known pulverizing means, for example, a ball milling (a ball mill, a vibrating ball mill and an epicyclic ball mill), a sand milling, a colloid milling, a jet milling, and a roller milling in the presence of a dispersant. In this case, a solvent (for example, water and alcohol) may or may not coexist. Or, it is allowed that the dye is dissolved in a suitable solvent and then a non-solvent to the dye is added to precipitate the fine crystal particles of the dye, wherein a degradable surface active agent may be used. Or, it is allowed that the dye is first dissolved by controlling pH and then crystallized by changing pH.

The dye fine particles in a gelatin dispersion system have preferably an average particle size of 10 μm or less, more preferably 2 μm or less, and particularly preferably 0.5 μm or less. It is preferably 0.1 μm or less in some cases.

The dye fine particles can be added to any layer of the photographic constituent layers.

However, in order to effectively improve image sharpness, the layer containing the compound having an absorption in the same wavelength region as a spectral sensitizing region in each of the light-sensitive layers is provided under the light-sensitive layer concerned so that it is adjacent to the light-sensitive layer. The term "provided under the layer so that it is adjacent to the layer" means that it is provided closer to the support than the layer, and there can be included an embodiment in which the layer concerned is provided via the other hydrophilic colloid layers. To concretely explain, for example, "provided under a red-sensitive silver halide emulsion layer" may include an embodiment in which the hydrophilic colloid layer containing the dye is provided below this emulsion layer via a thin non-light-sensitive hydrophilic colloid layer (a coupler may be added). The hydrophilic colloid layer containing the dye is preferably provided directly under the light-sensitive emulsion layer without such the layer being interposed therebetween.

With respect to the total use amount of the dye in the light-sensitive material, any amount necessary for the improvement of sharpness can be used, but it is preferably 0.01 to 0.80 g/m$^2$, more preferably 0.01 to 0.40 g/m$^2$, and most preferably 0.01 to 0.20 g/m$^2$.

In the method in which colloidal silver is used as a coloring layer component, a yellow or black colloidal silver gelatin dispersion generally used for a photographic light-sensitive material can be used. Colloidal silver used in the present invention is preferably a black color and after preparation, it is preferably desalted so sufficiently that the electroconductivity thereof becomes 1800 μS/cm or less. The use amount of colloidal silver in the colloidal silver-containing layer is preferably 0.01 to 0.5 g, particularly preferably 0.05 to 0.2 g, per m$^2$ as silver.

The colloidal silver can be prepared according to the methods described in, for example, U.S. Pat. Nos. 2,688,601 and 3,459,563, and Belgian Patent 622695.

Each yellow color developing silver halide emulsion layer, magenta color developing silver halide emulsion layer and cyan color developing silver halide emulsion layer can be provided on a support to thereby constitute the color light-sensitive material of the present invention. In a general color photographic paper, the color coupler forming a dye having a relationship of a complementary color with rays sensitizing a silver halide emulsion can be incorporated to carry out color reproduction by a subtractive color process. In a general color photographic paper, the silver halide emulsion grains are spectrally sensitized with the blue-sensitive, green-sensitive and red-sensitive spectral sensitizing dyes, respectively, in the above color developing layer order, and the respective emulsions can be coated on the support in the above order to constitute the color photographic paper. However, the order may be different from this. That is, the light-sensitive emulsion layer containing the silver halide grains with the largest average grain size is preferably provided uppermost from the viewpoint of rapid processing in some cases, and the lowest layer is preferably a magenta color developing light-sensitive emulsion layer from the viewpoint of storing performance under the irradiation of rays in some cases.

The light-sensitive layer and the developed color hue may have a constitution having no correlation disclosed above, and at least one infrared-sensitive silver halide emulsion layer may be set forth.

There are given as the silver halide grains used in the present invention, silver chloride, silver bromide, silver (iodo)bromochloride, and silver bromoiodide. In particular, in the present invention, silver halide comprising silver bromochloride or silver chloride containing substantially no silver iodide can be preferably used in order to expedite development processing time. The term "containing substantially no silver iodide" means that the silver iodide content is 1 mol % or less, preferably 0.2 mol % or less. Meanwhile, the high silver chloride grains containing silver iodide of 0.01 to 3 mol % on an emulsion surface described in JP-A-3-84545 are preferably used in some cases for the purposes of increasing sensitivity at a high illuminance, raising spectral sensitization sensitivity and improving storing stability of a light-sensitive material. The halogen composition of the emulsion may be different or equivalent by grain. The use of an emulsion containing grains each having the same composition readily homogenizes the quality of each of the grains. With respect to the halogen composition distribution in the inside of the silver halide emulsion grain, there can suitably be selected and used the grains of a so-called homogeneous type structure in which the composition is the same at any part of the silver halide grain, the grains of a so-called laminating type structure in which a core present on the inside of the silver halide grain and a shell (one layer or plural layers) surrounding it have different halogen compositions, or the grains of the structure in which there are present portions having different halogen compositions at the inside or the surface of the grain in the form of a non-layer (the structure in which the portions of the different compositions are conjugated at the edge, corner or surface of the grain where they are present on the surface of the grain). The use of either of the latter two types rather than the grains of the homogeneous structure is advantageous for obtaining a high sensitivity and is preferred as well from the viewpoint of pressure resistance performance. Where the silver halide grains have the above structures, the boundary at the portions having the different halogen compositions may be a distinct boundary or an indistinct boundary in which a mixed crystal is formed according to the composition difference, or there may be a structure in which a continuous structural change is allowed to positively be provided.

A so-called high silver chloride emulsion having a high silver chloride content is preferably used for a light-sensitive material suitable for rapid processing as is the case in the present invention. In the present invention, the silver chloride content in the high silver chloride emulsion is preferably 90 mole % or more, more preferably 95 mole % or more.

In such a high silver chloride emulsion, preferred is an emulsion having a structure in which a silver bromide-localizing phase is present in the form of the layer or non-layer as mentioned above on the inside of a silver halide grain and/or on the surface thereof. The halogen composition in the above localizing phase is preferably at least 10 mole %, more preferably more than 20 mole % and up to 100 mol %, in terms of a silver bromide content.

The silver bromide content in the silver bromide-localizing phase can be analyzed with an X-ray diffraction process (described in, for example, *New Experimental Chemistry Course 6, Structural Analysis* edited by Japan Chemistry Association, Maruzen). These localizing phases can be present inside a grain or at the edge, corner or plane of the grain surface. The localizing phase epitaxially grown at the corner portion of the grain can be enumerated as one preferred example.

It is effective as well to further increase the silver chloride content of a silver halide emulsion for the purpose of reducing the replenishing amount of the development processing solution. In such a case, an emulsion of almost pure silver chloride having a silver chloride content of 98 to 100 mol % is preferably used as well.

The sliver halide grain contained in the silver halide emulsion used in the present invention has preferably an average grain size (the grain size is defined by the diameter of the circle having the same area as that of the projected area of the grain and a number average is calculated therefrom) of 0.1 to 2 μm.

In the size distribution of these grains, preferred is a so-called monodispersion in which the fluctuation coefficient (obtained by dividing the standard deviation in the grain size distribution with an average grain size) is 20% or less, preferably 15% or less, and more preferably 10% or less. In this case, the above monodispersed emulsions are preferably used for the same layer in a blend or simultaneously coated for the purpose of obtaining a broad latitude.

There can be used as the silver halide grains contained in a photographic emulsion, grains having a regular crystal form such as cube, octahedron and tetradecahedron, grains having an irregular crystal form such as sphere and plate, or a composite form thereof. Further, the emulsion may consist of a mixture of grains having various crystal forms. In the present invention, of these emulsions, preferred is one containing grains having a regular crystal form by 50% by weight or more, preferably 70% by weight or more, and more preferably 90% by weight or more.

In addition thereto, preferably used as well is an emulsion in which the tabular grains having an average aspect ratio (circle area-corresponding diameter/thickness) of 5 or more, preferably 8 or more exceed 50% of the total grains.

The emulsion used in the present invention can be synthesized by the methods described in *Chemie et Physique Photographique* written by P. Glafkides (published by Paul Montel Co., Ltd., 1967), *Photographic Emulsion Chemistry* written by G. F. Duffin (published by Focal Press Co., Ltd., 1966), and *Making and Coating Photographic Emulsion* written by V. L. Zelikman, (published by Focal Press Co., Ltd., 1964). That is, there may be used any an acid method, a neutral method or an ammonia method. Any of a single jet method, a double jet method or a combination thereof may be used as the method for allowing a water soluble silver salt to react with a water soluble halide. There can be used as well a method in which the grains are formed in the presence of excessive silver ions (a so-called reverse mixing method). There can be used as one form of the double jet method, the method in which the pAg of the solution in which the sliver halide grains are formed is maintained constant, a so-called controlled double jet method. There can be obtained with this method, a silver halide emulsion having a regular crystal form and an almost uniform grain size.

A different kind of a metal ion or a complex ion thereof is preferably incorporated into the localizing phase or substrate of the silver halide grains according to the present invention. The preferred metal is selected from the metal ions or metal complexes thereof belonging to VIII group and IIb group, a lead ion, and a thallium ion. There can be used for the localizing phase, mainly an ion or a complex ion thereof selected from iridium, rhodium and iron. For the substrate, mainly the metal ion or complex ion thereof is selected from osmium, iridium, rhodium, platinum, ruthenium, palladium, cobalt, nickel, and iron. The metal ions, the kinds and concentrations of which are different in the localizing phase and substrate, can be used. A plurality of these metals may be used. In particular, the iron and iridium compounds are preferably present in the silver bromide-localized phase.

These metal ion-providing compounds are incorporated into the localizing phase and/or other grain portions (substrate) by adding to a gelatin aqueous solution which is a dispersant, a silver salt aqueous solution or other aqueous solutions during the formation of the silver halide grains, or by adding it in the form of a silver halide fine grain into which the metal ion has been incorporated in advance and dissolving this fine grain.

The metal ions used in the present invention can be incorporated into the emulsion grains before grain formation, during grain formation or immediately after grain formation. This can be changed according to at in what position the grain the metal ion is to be incorporated.

The silver halide emulsion used in the present invention is usually subjected to chemical sensitization and spectral sensitization.

There can be used singly or in combination as the chemical sensitization, a chemical sensitization in which a chalcogen sensitizer is used (to be concrete, there can be enumerated a sulfur sensitization represented by the addition of an unstable sulfur compound, a selenium sensitization with a selenium compound, and a tellurium sensitization with a tellurium compound), a noble metal sensitization represented by a gold sensitization, and a reduction sensitization. Those compounds described in the right lower column at page 18 to the right upper column at page 22 of JP-A-62-215272 are preferably used as the compounds for the chemical sensitization.

The emulsion used in the present invention is a so-called surface latent image type emulsion in which a latent image is formed primarily on the grain surface.

Various compounds or the precursors thereof can be added to the silver halide emulsion used in the present invention for the purposes of preventing fog or stabilizing photographic performances during a production process and during storing or photographic processing. Those compounds described at pages 39 to 72 of above JP-A-62-215272 are preferably used as the concrete examples of these compounds. Further, preferably used as well is the 5-arylamino-1,2,3,4-thiatriazole compound (the aryl residue has at least one electron attractive group) described in EP 0,447,647.

A spectral sensitization is carried out for the purpose of providing the emulsions contained in the respective layers of the light-sensitive material of the present invention with spectral sensitivities in the prescribed wavelength regions.

In the light-sensitive material of the present invention, there can be enumerated as the spectral sensitizing dye used for the spectral sensitizations in the blue, green and red regions, the compounds described in *Heterocyclic Compounds-Cyanine Dyes and Related Compounds* written by F. M. Harmer (published by John Wiley & Sons, New York, London, 1964). Those dyes and methods described in the right upper column at page 22 to page 38 of above JP-A-62-215272 are preferably used as the concrete examples of the compounds and the spectral sensitizing methods. In particular, the spectral sensitizing dyes described in JP-A-3-123340 are preferred very much as the red-sensitive spectral sensitizing dyes for the silver halide emulsion grains having a high silver chloride content from the viewpoint of stability, strength of adsorption and temperature dependency during exposure.

Where the spectral sensitization in an infrared region is efficiently carried out with the light-sensitive material of the present invention, preferably used are the sensitizing dyes described in the left upper column at page 12 to the left lower column at page 21 of JP-A-3-15049, in the left lower column at page 4 to the left lower column at page 15 of JP-3-20730, on the 21st line at page 4 to the 54th line at page 6 of EP 0,420,011, on the 12th line at page 4 to the 33rd line at page 10 of EP 0,420,012, and in EP 0,443,466 and U.S. Pat. 4,975,362.

In order to incorporate these spectral sensitizing dyes into a silver halide emulsion, they may be dispersed directly in the emulsion, or may be dissolved in a single solvent or mixed solvent such as water, methanol, ethanol, propanol, methyl cellosolve, and 2,2,3,3-tetrafluoropropanol to be added to the emulsion. Also, as described in JP-B-44-23389 (the term "JP-B" as used herein means an examined Japanese patent publication), JP-B-44-27555 and JP-B-57-22089, the dyes may be dissolved in water in the presence of an acid or a base, and as described in U.S. Pat. Nos. 3,822,135 and 4,006,025, an aqueous solution or colloid dispersion which are prepared in the presence of a surface active agent may be added to the emulsion. Further, after dissolving the dye in a solvent which is substantially immiscible with water, such as phenoxyethanol, the solution may be dispersed in water or a hydrophilic colloid to be added to the emulsion. As described in JP-A-53-102733 and JP-A-58-105141, the dispersion, which is prepared by dispersing the dyes directly in a hydrophilic colloid, may be added to the emulsion.

The timing of adding the sensitizing dyes to the emulsion may be at any step during the preparation of the emulsion, which has so far been known to be effective. That is, it can be before grain formation of the silver halide emulsion, during grain formation, from immediately after grain formation to before proceeding to a washing step, before chemical sensitization, during chemical sensitization, from immediately after chemical sensitization to solidification of the emulsion by cooling, and in the preparation of a coating solution. Most usually, it is carried out during the period of from after the completion of the chemical sensitization to before coating. However, as described in U.S. Pat. Nos. 3,628,969 and 4,225,666, the dyes can be added at the same time as the chemical sensitization to carry out spectral sensitization simultaneously with chemical sensitization. Also, as described in JP-A-58-113928, spectral sensitization can be carried out prior to chemical sensitization. The sensitizing dyes can be added before completing the preparation of the silver halide grains to start spectral sensitization. Further, as taught in U.S. Pat. No. 4,225,666, a divided sensitizing dye can be added; that is, a part thereof is added prior to chemical sensitization and the rest is added after chemical sensitization. The addition of the spectral sensitizing dyes may be at any period during the formation of the silver halide grains according to the method taught in U.S. Pat. No. 4,183,756 and other articles. Among them, particularly preferred is the addition of the sensitizing dyes before a step of washing the emulsion or before chemical sensitization.

The addition amount of these spectral sensitizing dyes is extended over a wide range according to the use. It preferably falls within the range of $0.5\times10^{-6}$ to $1.0\times10^{-2}$ mole, more preferably $1.0\times10^{-6}$ to $5.0\times10^{-3}$ mole per mole, of silver halide.

In the present invention, where a sensitizing dye having a spectral sensitization sensitivity particularly in the red region to the infrared region is used, the compounds described in the right lower column at page 13 to the right lower column at page 22 of JP-A-2-157749 are preferably used in combination. The use of these compounds can specifically increase the storing performance, stability during processing and super-sensitization effect of a light-sensitive material. Above all, the compounds of Formulas (IV), (V) and (VI) in the above patent are particularly preferably used in combination. These compounds are used in an amount of $0.5\times10^{-5}$ to $5.0\times10^{-2}$ mole, preferably $5.0\times10^{-5}$ to $5.0\times10^{-3}$ mole, per mole of silver halide. The most advantageous amount of those compounds falls within the range of 1 to 10000 times, preferably 0.5 to 5000 times, the mole of the sensitizing dye.

Gelatin is advantageously used as the binder or protective colloid which can be used for the light-sensitive material according to the present invention, and other hydrophilic colloids can be used either singly or together with gelatin. Low calcium gelatin having the calcium content of 800 ppm or less, more preferably 200 ppm or less, is preferably used. Further, the antifungal substance described in JP-A-63-271247 are preferably added in order to preclude various molds and fungi which would otherwise grow in a hydrophilic colloid layer to deteriorate an image.

The light-sensitive material according to the present invention may be exposed with either a visible ray or an infrared ray. The exposing method may be either a low illuminance exposure or a high illuminance exposure. There can be given as the preferred exposing method for the high illuminance exposure, a laser scanning exposing system in which the exposing time per pixel is shorter than $10^{-4}$ second, preferably shorter than $10^{-6}$ second.

During exposure, the band stop filter described in U.S. Pat. No. 4,880,726 is preferably used, whereby a light mixture is removed to notably improve color reproduction.

An exposed light-sensitive material can be subjected to conventional color development processing. In case of the color light-sensitive material of the present invention, it is preferably subjected to a bleach-fixing processing after the color development for the purpose of rapid processing. In particular, where the above high silver chloride emulsion is used, pH of the bleach-fixing solution is preferably 6.5 or less, more preferably about 6 or less, for the purpose of accelerating desilvering.

The material and techniques described in the following patent publications, particularly European Pat. EP 0,355,660A2 (JP-A-2-139544), are preferably used as the silver halide emulsions, other materials (i.e., the additives) and photographic constituent layers (i.e., the layer arrangement) each applied to the light-sensitive material according to the present invention, and the processing methods and additives for processing, which are used for processing this light-sensitive material:

TABLE 1-5

| Photographic elements | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, line 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, lines 4 to 9. |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulusion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |
| High boiling and/or low boiling organic solvent | p. 137, left lower column, line 9 to p. 144, right upper, last line. | p. 35, right lower column, line 14 to p. 36, left upper, line 4. | p. 64, lines 1 to 51. |
| Method for | p. 144, left lower column, | p. 27, right lower column, | p. 63, line 51 to p. |

TABLE 1-5-continued

| Photographic elements | JP-A-62-215272 | JP-A-2-33144 | EP 0355660A2 |
|---|---|---|---|
| dispersing photographic additives | line 1 to p. 146, right upper column, line 7. | line 10 to p. 28, left upper, last line, and p. 35, right lower column, line 12 to p. 36, right upper column, line 7. | 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, line 1 to 15. | p. 45 lines 41 to 52. |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, line 8 to 11. | p. 64, line 57 to p. 65 line 1. |
| Gradation controller | p. 188, right lower column, line 4 to 8. | — | — |
| Anti-stain agent | p. 188, right lower column, line 9 to p. 193, right lower column, line 10 | p. 37, left upper column, last line to right lower column, line 13. | p. 65, line 32 to p. 66, line 17. |
| Surface active agent | p. 201, left lower column, line 1 to p. 210, right upper column, last line. | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25 left upper column, line 1 to p. 27, right lower column, line 9. | |
| Binder (hydrophilic colloid) | p. 222, left lower column, line 6 to p. 225, left upper column, last line. | p. 38, right upper column, line 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited JP-A-62-215272, the content amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

The cyan, magenta and yellow couplers are preferably impregnated in a loadable latex polymer (for example, U.S. Pat. No. 4,203,716) or dissolved together with a water insoluble and organic solvent soluble polymer in the presence or absence of the organic high boiling solvents described in the above table to emulsify and disperse those couplers in a hydrophilic colloid aqueous solution.

There can be enumerated as the water insoluble and organic solvent soluble polymer which can be preferably used, the homopolymers or copolymers described in the 7th to 15th columns of U.S. Pat. No. 4,857,449 and at pages 12 to 30 of International Pat. Publication WO88/00723. A methacrylate series or acrylamide series polymer, particularly an acrylamide series polymer is preferably used in terms of the stabilization of the dye image.

In the light-sensitive material according to the present invention, the color image preservability-improving compounds described in European Pat. EP 0,277,589A2 are preferably used together with a coupler. In particular, they are used preferably in combination with a pyrazoloazole type coupler and a pyrrolotriazole type coupler.

That is, further preferably used simultaneously or singly for preventing side effects, such as the generation of stain due to the reaction of a color developing agent or the oxidation product thereof remaining in a layer during storage after processing with a coupler, are the compounds which chemically combine with an aromatic amine type developing agent remaining after color development processing to form a chemically inactive and substantially colorless compound, and/or the compounds which chemically combine with the oxidation product of an aromatic amine type developing agent remaining after color development processing to form a chemically inactive and substantially colorless compound.

In addition to the compounds described in the above tables, preferably used as the yellow coupler are the acylacetoamide type yellow couplers having an acyl group with a 3- to 5-membered cyclic structure described in European Pat. EP 0,447,969A1, the malondianilide type yellow couplers having a cyclic structure described in European Pat. EP 0,482,552A1, and the acylacetoamide type yellow couplers having a dioxane structure described in U.S. Pat. No. 5,118,599. Of them, particularly preferably used are the acylacetoamide type yellow couplers in which the acyl group is a 1-alkylcyclopropane-1-carbonyl group, and the malondianilide type yellow couplers in which one of anilides constitutes an indoline ring. These couplers can be used singly or in combination.

There can be used as the magenta coupler used in the present invention, the 5-pyrazolone series magenta couplers and pyrazoloazole series magenta couplers described in the literature references shown in the above tables. Of them, preferably used in terms of stability of hue and image and color development are the pyrazolotriazole couplers in which a secondary or tertiary alkyl group is connected directly to the 2-, 3-or 6-position of a pyrazolotriazole ring described in JP-A-61-65245, the pyrazoloazole couplers containing a sulfonamide group in the molecule described in JP-A-61-65246, the pyrazoloazole couplers having an alkoxyphenylsulfonamide ballast group described in JP-A-61-147254, and the pyrazoloazole couplers having an alkoxy group or aryloxy group at the 6-position described in European Patents 226,849A and 294,785A.

In addition to the methods described in the above tables, preferred as the processing method for the color light-sensitive material of the present invention are the processing materials and processing methods described on the 1st line of the right lower column at page 26 to the 9th line of the right upper column at page 34 of JP-A-2-207250, and on the 17th line of the left upper column at page 5 to the 20th line of the right lower column at page 18 of JP-A-4-97355.

EXAMPLES

The present invention will be explained below with reference to the examples, but is not limited thereto.

Example 1

A multilayered color photographic paper having the following layer constitution was prepared on a paper support laminated on the both sides thereof with polyethylene. The coating solutions were prepared in the following manner.

Preparation of the eighth layer coating solution

Ethyl acetate (100 ml) was added to a cyan coupler (the exemplified Coupler 11) (35.0 g), a high boiling solvent (Solv-3) (53.0 g), a high boiling solvent (Solv-5) (53.0 g), a dye image stabilizer (Cpd-1) (35.0 g), a dye image stabilizer (Cpd-5) (18.0 g), a dye image stabilizer (Cpd-6) (7.0 g), a dye image stabilizer (Cpd-8) (30.0 g), and sodium dodecylbenzenesulfonate (10.0 g) to dissolve them. This solution was emulsified and dispersed in a 20% gelatin aqueous solution with a high speed stirring emulsifier.

Meanwhile, red-sensitive sensitizing Dye E shown below was added to the silver bromochloride Emulsion R (cube, the 5:5 mixture (silver mole ratio) of the large size emulsion $R_1$ with an average grain size of 0.60 μm and the small size emulsion $R_2$ with an average grain size of 0.48 μm, wherein the fluctuation coefficients in the grain size distributions were 0.06 and 0.08, respectively; and either size emulsions comprised grains in which silver bromide 0.5 mol % was localized on a part of the grain surface and the rest was silver chloride) in amounts of $1.0\times10^{-4}$ mole per mole of silver halide to the large size emulsion and $1.2\times10^{-4}$ mole per mole of silver halide to the small size emulsion. Then, this emulsion was subjected to a sulfur sensitization and a gold sensitization by the addition of a sulfur sensitizer and a gold sensitizer. The foregoing emulsified dispersion and this emulsion were mixed and dissolved, whereby the eighth layer coating solution was prepared so that it had the following composition.

Further, a white pigment dispersion, a colloidal silver dispersion (the coloring component) and a solid matter dispersion of dye fine particles (the coloring component), each used for the hydrophilic colloid layers according to the present invention were prepared in the following manner.

Preparation of the white pigment dispersion

The rutile type titan white pigment with an average particle size of 0.23 μm (Titan White R780 manufactured by Ishiwara Sangyo Co., Ltd.) (400 g) and water (4 liters) were added to a 10% gelatin aqueous solution (1.0 kg) and then, a 5% sodium dodecylbenzenesulfonate aqueous solution (8 ml) was added thereto as a dispersant, followed by dispersing by the irradiation of a supersonic wave.

Preparation of the colloidal silver

Sodium carbonate anhydrous (2 g) was added to a 10% gelatin aqueous solution (1 kg) and a 10% silver nitrate aqueous solution (500 ml) was added thereto while maintaining the temperature at 45° C. Then, the aqueous solution (1000 ml) containing sodium sulfite anhydrous (35 g) and hydroquinone (25 g) was added over the period of 10 minutes. After being left to stand for 10 more minutes, 1N sulfuric acid about (100 ml) was added to adjust the pit to 5.0. The colloidal silver sol thus obtained was poured into a cooling dish to sufficiently gelatinize it and then it was cut to the form of a noodle, followed by washing with cold water for 6 hours to sufficiently desalt it.

Preparation of the solid matter dispersion dye

The dye was dispersed with a vibrating ball mill in the following manner. Water (21.7 ml), a 5% aqueous solution (3 ml) of sodium P-octylphenoxyethoxyethanesulfonate, and a 5% aqueous solution (0.5 g) of p-octylphenoxy poly(polymerization degree: 10)oxyethylene ether were put in a 700 ml pot mill. The dye (S-1, S-2 or S-3) (0.5 g) according to the present invention was added thereto together with the beads (diameter: 1 mm, volume: 500 ml) of zirconium oxide and the content was dispersed for 2 hours. The vibrating ball mill used was the BO type manufactured by Chuo Kakoki Co., Ltd.

The content was taken out and added to a 12.5% gelatin aqueous solution (8 g), followed by filtrating the beads off, whereby a dye gelatin dispersion was obtained.

The coating solutions for the first to the seventh and the ninth to the tenth layers were prepared in the same manner as the eighth layer coating solution.

Cpd-10 and Cpd-11 were added to the respective layers so that the total amounts thereof became 25.5 mg/m$^2$ and 50.0 mg/m$^2$, respectively.

Cpd-13 was added to the respective layers as a hardener so that the amount thereof became 1 millimole per g of gelatin.

The following spectral sensitizing dyes were used for the silver bromochloride emulsions contained in the respective light-sensitive emulsion layers:

Blue-sensitive emulsion layer

Sensitizing Dye A

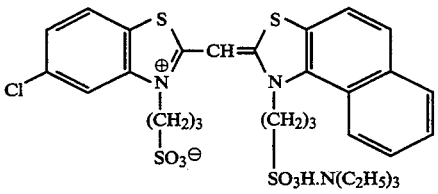

and

-continued

Sensitizing Dye B

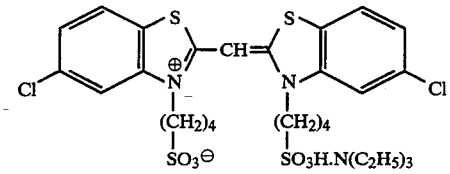

(each dye was added in the amount of $2.0\times10^{-4}$ mole per mole of silver halide to the large size emulsion and each dye was added in the amount of $2.5\times10^{-4}$ mole per mole of silver halide to the small size emulsion).

Green-sensitive emulsion layer

Sensitizing Dye C

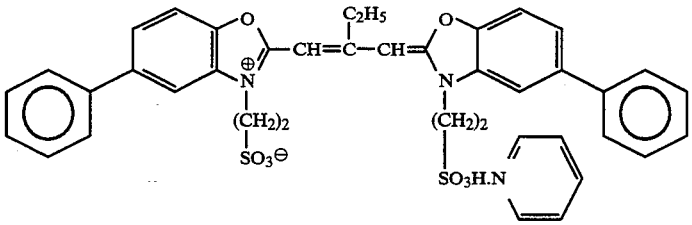

(the dye was added in the amount of $4.0\times10^{-4}$ mole per mole of silver halide to the large size emulsion and the dye was added in the amount of $5.6\times10^{-4}$ mole per mole of silver halide to the small size emulsion)

Sensitizing Dye D

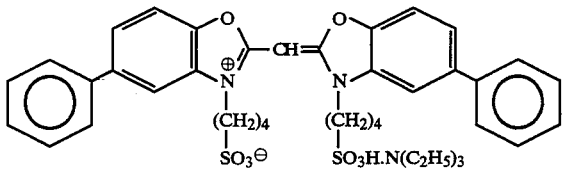

(the dye was added in the amount of $7.0\times10^{-5}$ mole per mole of silver halide to the large size emulsion and the dye was added in the amount of $1.0\times10^{-4}$ mole per mole of silver halide to the small size emulsion).

Red-sensitive emulsion layer

Sensitizing Dye E

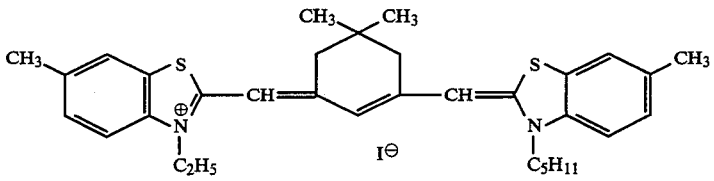

(the dye was added in the amount of $1.0\times10^{-4}$ mole per mole of silver halide to the large size emulsion and the dye was added in the amount of $1.2\times10^{-4}$ mole per mole of silver halide to the small size emulsion).

Further, the following compound was added into a red-sensitive layer in the amount of $2.6\times10^{-3}$ mole per mole of silver halide:

The following dyes (the numeral in the parenthesis represents the coated amount) were added to the emulsion layers to prevent irradiation:

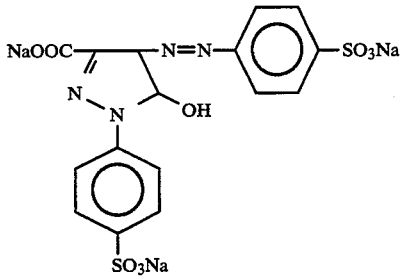

(5 mg/m²)

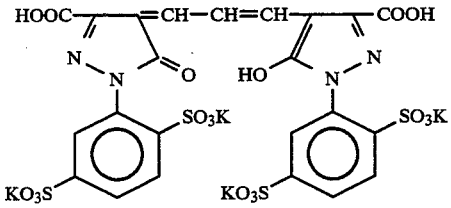

(5 mg/m²)

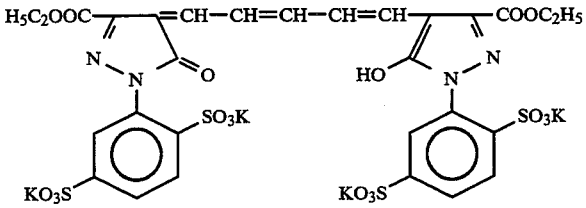

(20 mg/m²)

and

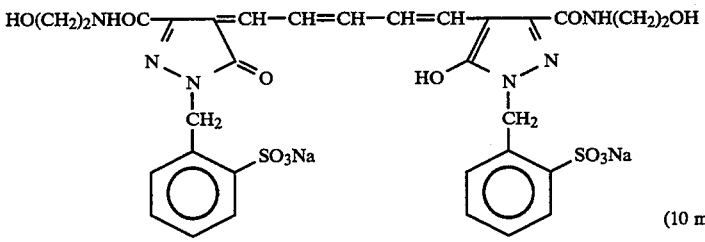

(10 mg/m²)

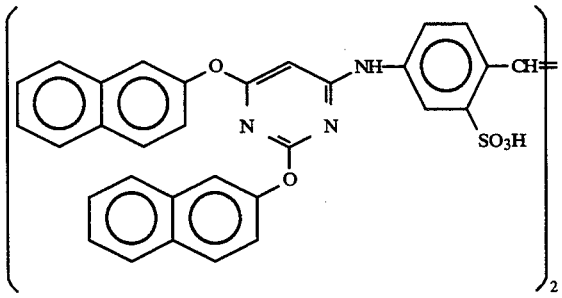

Further, 1-(5-methylureidophenyl)-5-mercaptotetrazole was added to the blue-sensitive emulsion layer, the green-sensitive emulsion layer and the red-sensitive emulsion layer in the amounts of $3.4\times10^{-4}$ mole, $9.7\times10^{-4}$ mole and $5.5\times10^{-4}$ mole per mole of silver halide, respectively.

Further, 4-hydroxy-6-methyl-,1,3,3a,7-tetrazaindene was added to the blue-sensitive emulsion layer and the green-sensitive emulsion layer in the amounts of $1\times10^{-4}$ mole and $2\times10^{-4}$ mole per mole of silver halide, respectively.

Layer constitution

The compositions of the respective layers are shown below. The numerals represent the coated amounts (g/m²). The coated amounts of the silver halide emulsions are expressed in terms of the amounts converted to silver.

Support

Polyethylene laminated paper [polyethylene with the thickness of 30 μm coated on the first layer side contains a white pigment (titanium dioxide) in the filling rate of 10 weight % and a blue dye (ultramarine)].

| | |
|---|---|
| First layer (a white pigment-containing hydrophilic colloid layer): | |
| Gelatin | 1.50 |
| White pigment (above rutile type titan white pigment) | 6.00 |
| Second layer (a coloring layer): | |
| Gelatin | 0.99 |
| Colloidal silver | 0.12 |
| Anti-color mixing agent (Cpd-5) | 0.08 |
| Solvent (Solv-1) | 0.16 |
| Solvent (Solv-4) | 0.08 |

-continued

| | |
|---|---|
| Third layer (an intermediate layer): | |
| Gelatin | 0.99 |
| Anti-color mixing agent (Cpd-5) | 0.08 |
| Solvent (Solv-1) | 0.16 |
| Solvent (Solv-4) | 0.08 |
| Fourth layer (a yellow color developing emulsion layer): | |
| Silver bromochloride emulsion (cube, 3:7 mixture (Ag mole ratio) of the large size emulsion A having an average grain size of 0.88 μm and the small size emulsion A having an average grain size of 0.70 μm, wherein the fluctuation coefficients in the grain size distributions were 0.08 and 0.10, respectively, and either size emulsion comprised grains in which silver bromide 0.3 mol % was localized on a part of the grain surface and the rest was silver chloride) | 0.27 |
| Gelatin | 1.20 |
| Yellow coupler (ExY) | 0.75 |
| Dye image stabilizer (Cpd-2) | 0.02 |
| Dye image stabilizer (Cpd-1) | 0.20 |
| Solvent (Solv-1) | 0.25 |
| Dye image stabilizer (Cpd-3) | 0.10 |
| Fifth layer (an anti-color mixing layer): | |
| Gelatin | 0.80 |
| Anti-color mixing agent (Cpd-4) | 0.08 |
| Solvent (Solv-6) | 0.02 |
| Solvent (Solv-2) | 0.25 |
| Solvent (Solv-3) | 0.25 |
| Sixth layer (a magenta color developing emulsion layer): | |
| Silver bromochloride emulsion (cube, 6:4 mixture (Ag mole ratio) of the large size emulsion G1 having an average grain size of 0.55 μm and the small size emulsion G2 having an average grain size of 0.39 μm, wherein the fluctuation coefficients in the grain size distributions were 0.10 and 0.08, respectively, and either size emulsion comprised grains in which silver bromide 0.8 mol % was localized on a part of the grain surface and the rest was silver chloride) | 0.13 |
| Gelatin | 0.12 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Seventh layer (an anti-color mixing layer): | |
| Gelatin | 0.50 |
| Anti-color mixing agent (Cpd-4) | 0.04 |
| Solvent (Solv-6) | 0.01 |
| Solvent (Solv-2) | 0.18 |
| Solvent (Solv-3) | 0.18 |
| Eighth layer (a cyan color developing emulsion layer): | |
| Above silver bromochloride emulsion | 0.20 |
| Gelatin | 1.75 |
| Cyan coupler (exemplified compound 11) | 0.35 |
| Solvent (Solv-3) | 0.53 |
| Solvent (Solv-5) | 0.53 |
| Dye image stabilizer (Cpd-1) | 0.35 |
| Dye image stabilizer (Cpd-5) | 0.18 |
| Dye image stabilizer (Cpd-6) | 0.07 |
| Dye image stabilizer (Cpd-8) | 0.30 |
| Ninth layer (a UV absorbing layer): | |
| Gelatin | 0.50 |
| UV absorber (UV-1) | 0.42 |
| Dye image stabilizer (Cpd-9) | 0.15 |
| Dye image stabilizer (Cpd-5) | 0.02 |
| Tenth layer (a protective layer): | |
| Gelatin | 1.00 |
| Acryl-modified copolymer of polyvinyl alcohol (a modification degree: 17%) | 0.15 |
| Liquid paraffin | 0.03 |
| Additive (Cpd-12) | 0.01 |

The compounds used herein are shown below:

(ExY) Yellow Coupler
1:1:1 mixture (weight ratio) of

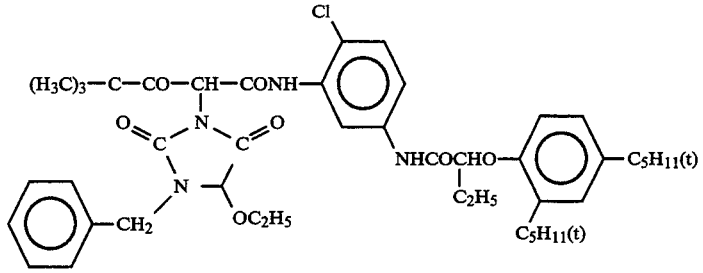

and

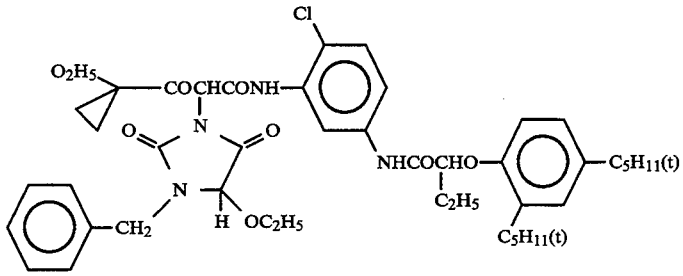

and

-continued
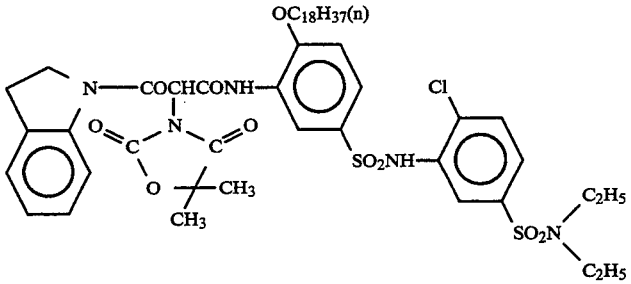
(ExM) Magenta coupler
1:1 mixture (moler ratio) of
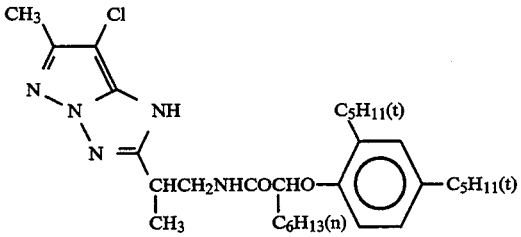
and
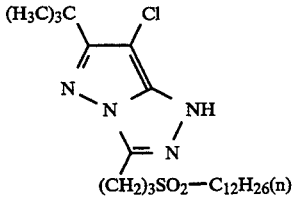
(Cpd-1) Dye image stabilizer
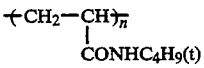
Average molecular weight: 60,000
(Cpd-2) Dye image stabilizer
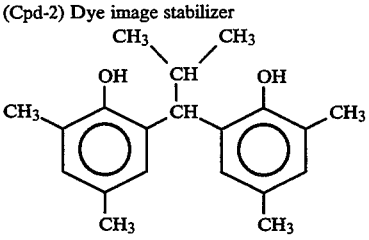
(Cpd-3) Dye image stabilizer
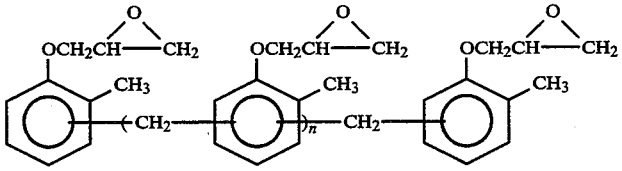
n = 7 to 8 (average value)
(Cpd-4) Anti-color mixing agent
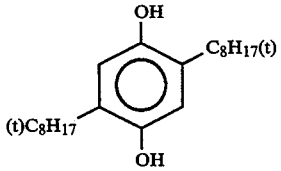
(Cpd-5) Dye image stabilizer -continued
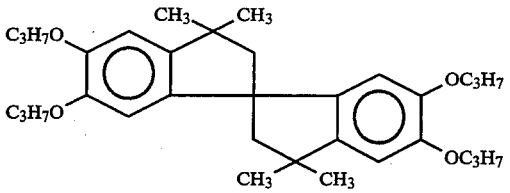
(Cpd-6) Dye image stabilizer
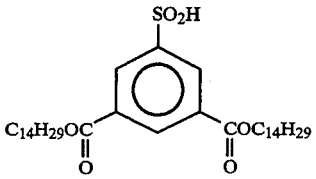
(Cpd-7) Dye image stabilizer
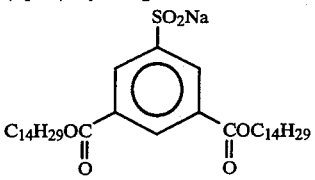
(Cpd-8) Dye image stabilizer
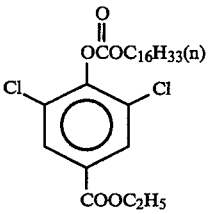
(Cpd-9) Dye image stabilizer
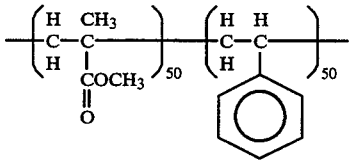
Average molecular weight: 60,000
(Cpd-10) Preservative
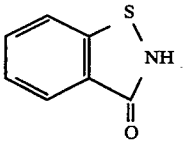
(Cpd-11) Preservative
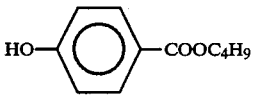
(Cpd-12) Additive
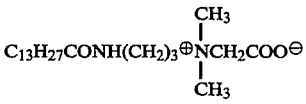
(Cpd-13) Dye image stabilizer
1:1 mixture (mole ratio)

-continued
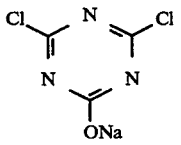
and
$CH_2{=}CHSO_2CH_2CONH{-}CH_2{-}CH_2NHCOCH_2SO_2CH{=}CH_2$
(UV-1) UV absorber
2:1:4:3 mixture (weight ratio) of (i), (ii), (iii) and (iv)
(i)
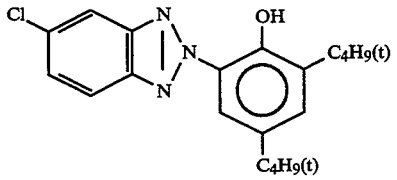
(ii)
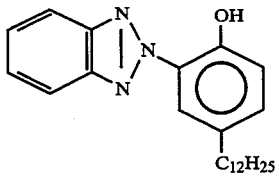
(iii)
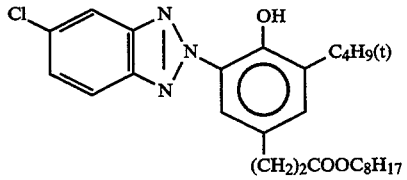
(iv)
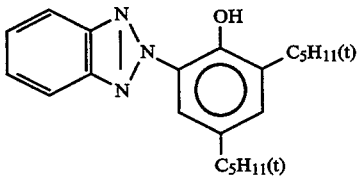
Solvent (Solv-1)
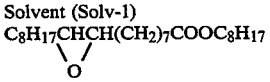
Solvent (Solv-2)
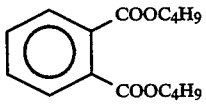
Solvent (Solv-3)
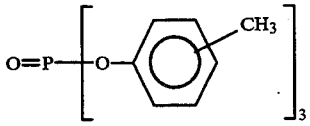
Solvent (Solv-4)
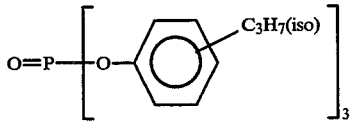

-continued

Solvent (Solv-5)

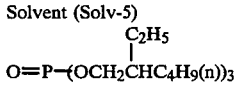

Solvent (Solv-6)

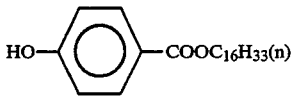

(S-1)

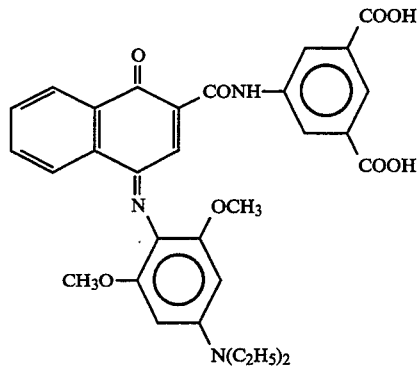

(S-2)

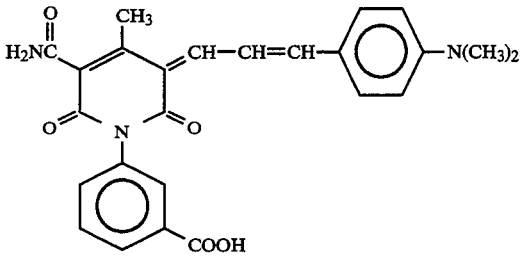

(S-3)

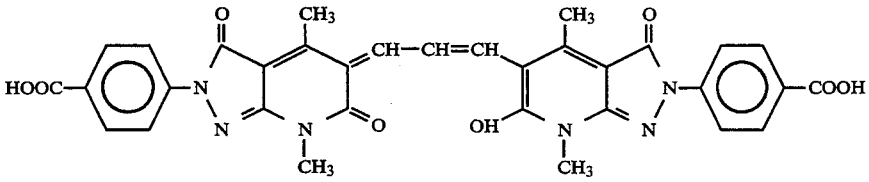

The sample thus obtained was designated as Sample No. 106. Sample Nos. 101 to 105 and 107 to 118 were prepared in the same manner as Sample No. 106 except that the compositions in the first layer, the second layer and the fifth layer were changed as shown in Table A. The filling rate of the white pigment in the first layer was changed by increasing or decreasing only the amount of the white pigment while keeping the gelatin amount fixed. Where the coloring component was not added to a second layer, a second layer was not provided. The cyan coupler contained in the fifth layer was replaced in the same weight.

First, Sample No. 106 was subjected to an exposure with a sensitometer (an FWH type, the color temperature of a light source: 3200° K., manufactured by Fuji Photo Film Co., Ltd.), wherein the exposure was given so that about 30% of the coated silver amount was developed and grey was given.

The samples thus exposed were subjected to a 250 $m^2$ continuous processing with a paper processing machine according to the following processing steps in the processing solutions of the following compositions.

| | Processing step | | | |
|---|---|---|---|---|
| Step | Temperature (°C.) | Time | Replenishing amount* (ml) | Tank capacity (l) |
| Color developing | 38.5° C. | 45 seconds | 73 | 10 |
| Bleach/fixing | 35 | 45 seconds | 60** | 10 |
| Rinsing (1) | 35 | 30 seconds | — | 10 |
| Rinsing (2) | 35 | 30 seconds | — | 10 |
| Rinsing (3) | 35 | 30 seconds | 360 | 10 |
| Drying | 80 | 60 seconds | | |

*Replenishing amount per $m^2$ of the light-sensitive material.

**In addition to above 60 ml, 120 ml per $m^2$ of the light-sensitive material was allowed to flow in from Rinsing (1). (Rinsing was of a countercurrent system from Rinsing (3) to Rinsing (1))

The compositions of the respective processing solutions were as follows:

| | Tank Solution | Replenisher |
|---|---|---|
| Color developer solution | | |
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (Whitex 4 manufactured by Sumitomo Chem. Ind. Co., Ltd.) | 1.0 g | 3.0 g |
| Sodium sulfite | 0.1 g | 0.1 g |
| Disodium N,N-bis(sulfonatethyl) hydroxylamine | 5.0 g | 10.0 g |
| Sodium triisopropylnaphthalene (β) suylfonate | 0.1 g | 0.1 g |
| N-ethyl-N-(β-methanesulfonamidothyl)-3-methyl-4-aminoaniline 3/2 sulfate monohydrate | 5.0 g | 11.5 g |
| Water was added to make | 1000 ml | 1000 ml |
| pH (25° C.) (adjusted with potassium hydroxide and sulfuric acid) | 10.00 | 10.00 |
| Bleach/fixing solution | | |
| Water | 600 ml | 150 ml |
| Ammonium thiosulfate (700 g/liter) | 100 ml | 250 ml |
| Ammonium sulfite | 40 g | 100 g |
| Iron (III) ammonium ethylenediaminetetracetate | 55 g | 135 g |
| Ethylenediaminetetraacetic acid | 5 g | 12.5 g |
| Ammonium bromide | 40 g | 75 g |
| Nitric acid (67%) | 30 g | 65 g |
| Water was added to make | 1000 ml | 1000 ml |
| pH (25° C.) (adjusted with acetic acid and aqueous ammonia) | 5.8 | 5.6 |

| Rinsing solution (Common to the tank solution and replenishing solution) | |
|---|---|
| Sodium chloroisocyanurate | 0.02 g |
| Deionized water (dielectric constant: 5 μS/cm or less) | 1000 ml |
| pH | 6.5 |

Next, each of the samples was subjected to a gradational exposure with the above sensitometer via a color separation filter and then to a processing with the processing solutions obtained after the above continuous processing. These samples were stored at 70° C. and relative humidity of 70% for 14 days to carry out a forced image deterioration test, whereby image storing performance was evaluated.

(1) Stain of a background (ΔY)

The reflection density of the background was measured with a densitometer X-Rite 310 (manufactured by X-Rite Company), and the density change before and after a forced weathering test was calculated.

(2) Color turbidity of a cyan dye image (ΔY/R)

The density of a yellow color at the portion giving the initial cyan density of 1.0 was measured before and after the forced weathering test and the density change in the yellow color was calculated.

The sharpness of the dye image was evaluated in the following manner:

A wedge obtained by forming on a glass substrate a rectangular pattern in which a spatial frequency with the density difference of 0.2 was changed was tightly contacted to each of the samples and an exposure was applied. The exposure was carried out via a red color filter and was adjusted so that the background density was 0.5. The density of a rectangular image was precisely measured with a micro densitometer and a CTF value in the spatial frequency of 2.5 cycles/mm was calculated for each sample. The higher the CTF value is, the higher the sharpness of the image is. The CTF value was represented by the value relative to that of Sample No. 101, which was set at 100.

The evaluation results of Sample Nos. 101 to 118 are shown in Table A.

TABLE A

| Sample No. | 5th layer cyan coupler | 1st layer: white pigment filling rate (weight %) | 2nd layer: coloring component ($g/m^2$) | Sharpness*1 CTF relative value (%) | Stain on the background (ΔY) | Color turbidity (ΔY/R) |
|---|---|---|---|---|---|---|
| 101 (Comp.) | 11 | 0 | — | 100 | 0.02 | 0.03 |
| 102 (Comp.) | 11 | 10 | — | 102 | 0.02 | 0.03 |
| 103 (Inv.) | 11 | 20 | — | 148 | 0.02 | 0.03 |
| 104 (Inv.) | 11 | 40 | — | 155 | 0.02 | 0.03 |
| 105 (Inv.) | 11 | 80 | — | 157 | 0.02 | 0.04 |
| 106 (Inv.) | 11 | 80 | Colloidal silver (0.12) | 178 | 0.03 | 0.04 |
| 107 (Inv.) | 11 | 80 | (S-1) (0.06) | 176 | 0.03 | 0.04 |
| 108 (Inv.) | 11 | 80 | (S-2) (0.06) | 178 | 0.03 | 0.04 |
| 109 (Inv.) | 11 | 80 | (S-3) (0.06) | 178 | 0.03 | 0.04 |
| 110 (Comp.) | ExC*2 | 0 | — | 99 | 0.02 | 0.18 |
| 111 (Comp.) | ExC*2 | 10 | — | 102 | 0.03 | 0.23 |
| 112 (Comp.) | ExC*2 | 20 | — | 148 | 0.04 | 0.26 |
| 113 (Comp.) | ExC*2 | 40 | — | 155 | 0.05 | 0.27 |
| 114 (Comp.) | ExC*2 | 80 | — | 157 | 0.05 | 0.28 |
| 115 (Comp.) | ExC*2 | 80 | Colloidal silver (0.12) | 177 | 0.06 | 0.29 |
| 116 (Comp.) | ExC*2 | 80 | (S-1) (0.06) | 176 | 0.07 | 0.29 |
| 117 (Comp.) | ExC*2 | 80 | (S-2) (0.06) | 178 | 0.07 | 0.29 |
| 118 (Comp.) | ExC*2 | 80 | (S-3) | 177 | 0.07 | 0.29 |

TABLE A-continued

| Sample No. | 5th layer cyan coupler | 1st layer: white pigment filling rate (weight %) | 2nd layer: coloring component (g/m²) | Sharpness*1 CTF relative value (%) | Stain on the background (ΔY) | Color turbidity (ΔY/R) |
|---|---|---|---|---|---|---|
| | | | (0.06) | | | |

*1Sharpness is represented by the CTF value relative to that of Sample No. 101, which was set at 100.
*2ExC: comparative cyan coupler.

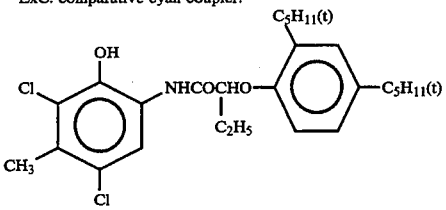

It can be found from the results summarized in Table A that setting the white pigment filling rate in the hydrophilic colloid layer containing the white pigment at 20 weight % or more can improve the sharpness of the image. In this case, where a conventional cyan coupler is used, yellowing on the background and color turbidity of the cyan dye image after a forced deterioration test are increased. On the contrary, where the cyan couplers of the present invention are used, the sharpness of the image can be improved while scarcely increasing the yellowing on the background and the color turbidity of the cyan dye image even if a forced deterioration test is carried out. The use of the cyan couplers of the present invention can further improve sharpness without having a bad influence by providing a hydrophilic colloid layer containing the white pigment at a filling rate of 20 weight % or more and adding the coloring additive capable of being decolored by the color development processing.

EXAMPLE 2

Sample Nos. 201 to 222 were prepared in the same manner as Sample No. 106 in Example 1, except that the density of the titanium oxide white pigment contained in polyethylene (a waterproof resin) laminated on the support was changed and except that the compositions in the first layer, second layer and fifth layer were varied as shown in Table B. Where the coloring component was not added to a second layer, a second layer was not provided. The method described in Example 1 of JP-A-3-156449 was used as the method for preparing the support in which the filling rate of titanium oxide contained in a laminated resin was changed. The layer thickness of laminated polyethylene was set at 20 μm. The cyan coupler ExC was replaced with the cyan coupler exemplified Coupler 11 in the same weight and the cyan coupler exemplified Couplers 5, 35, 19, 39, and 42 were replaced so that the addition amounts thereof was the same mole as that of the exemplified Coupler 11.

The results of the evaluation carried out with Sample Nos. 201 to 222 in the same manner as that in Example 1 are shown in Table B.

TABLE B

| Sample No. | 5th layer cyan coupler | White*1 pigment filling rate (wt %) | White*2 pigment filling rate (wt %) | 2nd layer: coloring component (g/m²) | Sharpness*3 CTF relative value (%) | Stain on the background (ΔY) | Color turbidity (ΔY/R) |
|---|---|---|---|---|---|---|---|
| 201 (Comp.) | 35 | 5 | 0 | — | 58 | 0.02 | 0.03 |
| 202 (Comp.) | 35 | 10 | 0 | — | 79 | 0.02 | 0.03 |
| 203 (Inv.) | 35 | 15 | 0 | — | 100 | 0.02 | 0.03 |
| 204 (Inv.) | 35 | 25 | 0 | — | 140 | 0.02 | 0.03 |
| 205 (Inv.) | 35 | 50 | 0 | — | 165 | 0.03 | 0.04 |
| 206 (Inv.) | 35 | 50 | 0 | Colloidal Ag (0.12) | 172 | 0.03 | 0.04 |
| 207 (Inv.) | 35 | 50 | 0 | (S-1) (0.06) | 170 | 0.03 | 0.04 |
| 208 (Inv.) | 35 | 50 | 0 | (S-3) (0.06) | 172 | 0.03 | 0.04 |
| 209 (Comp.) | ExC*4 | 5 | 0 | — | 58 | 0.02 | 0.18 |
| 210 (Comp.) | ExC*4 | 10 | 0 | — | 79 | 0.02 | 0.19 |
| 211 (Comp.) | ExC*4 | 15 | 0 | — | 100 | 0.04 | 0.22 |
| 212 (Comp.) | ExC*4 | 25 | 0 | — | 140 | 0.05 | 0.24 |
| 213 (Comp.) | ExC*4 | 50 | 0 | — | 165 | 0.06 | 0.26 |
| 214 (Comp.) | ExC*4 | 50 | 0 | Colloidal Ag (0.12) | 172 | 0.06 | 0.28 |
| 215 (Comp.) | ExC*4 | 50 | 0 | (S-1) (0.06) | 170 | 0.06 | 0.28 |
| 216 (Comp.) | ExC*4 | 50 | 0 | (S-3) (0.06) | 172 | 0.06 | 0.28 |
| 217 (Inv.) | 5 | 15 | 80 | Colloidal Ag (0.12) | 179 | 0.03 | 0.04 |
| 218 (Inv.) | 11 | 15 | 80 | Colloidal Ag (0.12) | 180 | 0.03 | 0.04 |
| 219 (Inv.) | 35 | 25 | 80 | Colloidal Ag (0.12) | 180 | 0.03 | 0.04 |

TABLE B-continued

| Sample No. | 5th layer cyan coupler | White*1 pigment filling rate (wt %) | White*2 pigment filling rate (wt %) | 2nd layer: coloring component (g/m²) | Sharpness*3 CTF relative value (%) | Stain on the background (ΔY) | Color turbidity (ΔY/R) |
|---|---|---|---|---|---|---|---|
| 220 (Inv.) | 19 | 25 | 80 | (S-3) (0.06) | 180 | 0.03 | 0.04 |
| 221 (Inv.) | 39 | 25 | 80 | (S-3) (0.06) | 180 | 0.03 | 0.04 |
| 222 (Inv.) | 42 | 25 | 80 | (S-3) (0.06) | 180 | 0.03 | 0.04 |

*1In waterproof resin layer.
*2In the first layer.
*3Sharpness is represented by the CTF value relative to that of Sample No. 101, which was set at 100.
*4ExC: the same comparative cyan coupler as in Example 1.

It can be found from the results summarized in Table B that the setting of the filling rate of the white pigment contained in the waterproof resin layer at 15 weight % or more can markedly improve the sharpness of the image. In this case, where the conventional cyan coupler is used, yellowing on the background and color turbidity of the cyan dye image after a forced deterioration test are increased. On the contrary, where the cyan couplers of the present invention are used, the sharpness of the image can be improved while scarcely increasing yellowing on the background and color turbidity of the cyan dye image even if a forced deterioration test is carried out. The use of the cyan couplers of the present invention can further improve the sharpness without having a bad influence, by increasing the filling rate of the white pigment contained in the waterproof resin layer to 15 weight % or more and adding a coloring additive capable of being decolored by the color development processing.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon a photographic constituent layer comprising a light-sensitive silver halide emulsion layer containing a yellow dye-forming coupler, a light-sensitive silver halide emulsion containing a magenta dye-forming coupler, and a light-sensitive silver halide emulsion layer containing a cyan dye-forming coupler, and non-light-sensitive hydrophilic colloid layers, wherein the above silver halide emulsion layer containing the cyan dye-forming coupler contains at least one cyan dye-forming coupler represented by the following Formula (IIIa) and wherein at least one of the non-light-sensitive hydrophilic colloid layers is provided between the support and the silver halide emulsion layer closest to the support and contains a white pigment at a density of 20 weight % or more: Formula (IIIa)

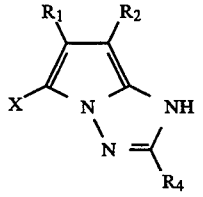

wherein $R_1$ and $R_2$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent; X represents a hydrogen atom or a group capable of splitting off upon a reaction with an oxidation product of an aromatic primary amine color developing agent; the group represented by $R_1$, $R_2$, $R_4$ or X may become a divalent group and combine with a polymer higher than a dimer and a high molecular chain to form a homopolymer or a copolymer.

2. The light-sensitive material of claim 1, wherein at least one layer of the above light-sensitive emulsion layers and non-light-sensitive hydrophilic colloid layer is a coloring layer capable of being decolored during a color development processing step.

3. The light-sensitive material of claim 1, wherein the emulsion layer containing the cyan dye-forming coupler is a red-sensitive silver halide emulsion layer.

4. The light-sensitive material of claim 1, wherein the addition amount of the cyan coupler in the silver halide emulsion layer is $1\times10^{-3}$ to 1 mole per mole of silver halide.

5. The light-sensitive material of claim 1, wherein the coating amount of the cyan coupler is $2.0\times10^{-6}$ to $2.0\times10^{-3}$ mole per $m^2$ of the light-sensitive material.

6. The light-sensitive material of claim 1, wherein the density of the white pigment in the hydrophilic colloid layer is 40 weight % or more.

7. The light-sensitive material of claim 1, wherein at least one light-sensitive silver halide emulsion layer comprises silver bromochloride emulsion containing 1 mole % or less of silver iodide and 90 mole % or more of silver chloride, or silver chloride emulsion.

8. The light-sensitive material of claim 2, wherein the coloring layer contains a fine powder dye or colloidal silver as a coloring layer component.

9. The light-sensitive material of claim 1, wherein $R_1$ is a cyano group; $R_2$ is a trifluoromethyl group, a cyano group, a straight or branched unsubstituted alkoxycarbonyl group, an alkoxycarbonyl group substituted with a carbonyl group, an ether linkage-containing alkoxycarbonyl group, an unsubstituted aryloxycarbonyl group, or an aryloxycarbonyl group substituted with an alkyl group or an alkoxy group; $R_4$ represents a hydrogen atom or a substituent; X represents a hydrogen atom or a group capable of splitting off upon a reaction with an oxidation product of an aromatic primary amine color developing agent.

10. The silver halide color photographic light-sensitive material comprising a reflective support covered with a waterproof resin layer and having provided thereon a photographic constituent layer comprising a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive hydrophilic colloid layer, wherein the above silver halide emulsion layer containing the cyan dye-forming coupler contains at least one cyan dye-forming coupler represented by the following Formula (IIIa) and wherein the above waterproof resin layer provided on the emulsion layer side of the support contains a white pigment at a density of 15 weight % or more:

Formula (IIIa)

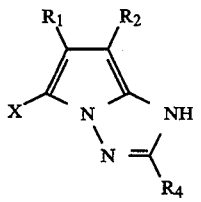

wherein $R_1$ and $R_2$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent; X represents a hydrogen atom or a group capable of splitting off upon a reaction with an oxidation product of an aromatic primary amine color developing agent; the group represented by $R_1$, $R_2$, $R_4$ or X may become a divalent group and combine with a polymer higher than a dimer and a high molecular chain to form a homopolymer or a copolymer.

11. The light-sensitive material of claim 10, wherein at least one layer of the above light-sensitive emulsion layers and non-light-sensitive hydrophilic colloid layer is a coloring layer capable of being decolored during a color development processing step.

12. The light-sensitive material of claim 10, wherein the emulsion layer containing the cyan dye-forming coupler is a red-sensitive silver halide emulsion layer.

13. The light-sensitive material of claim 10, wherein the addition amount of the cyan coupler in the silver halide emulsion layer is $1\times10^{-3}$ to 1 mole per mole of silver halide.

14. The light-sensitive material of claim 10, wherein the coating amount of the cyan coupler is $2.0\times10^{-6}$ to $2.0\times10^{-3}$ mole per $m^2$ of the light-sensitive material.

15. The light-sensitive material of claim 10, further containing a white pigment in at least one non-light sensitive hydrophilic colloid layer.

16. The light-sensitive material of claim 10, wherein at least one light-sensitive silver halide emulsion layer comprises silver bromochloride emulsion containing 1 mole % or less of silver iodide and 90 mole % or more of silver chloride, or silver chloride emulsion.

17. The light-sensitive material of claim 11, wherein the coloring layer contains a fine powder dye or colloidal silver as a coloring layer component.

18. The light-sensitive material of claim 10, wherein $R_1$ is a cyano group; $R_2$ is a trifluoromethyl group, a cyano group, a straight or branched unsubstituted alkoxycarbonyl group, an alkoxycarbonyl group substituted with a carbonyl group, an ether linkage-containing alkoxycarbonyl group, an unsubstituted aryloxycarbonyl group, or an aryloxycarbonyl group substituted with an alkyl group or an alkoxy group; $R_4$ represents a hydrogen atom or a substituent; X represents a hydrogen atom or a group capable of splitting off upon a reaction with an oxidation product of an aromatic primary amine color developing agent.

* * * * *